US011209746B2

(12) United States Patent
Yamamoto

(10) Patent No.: US 11,209,746 B2
(45) Date of Patent: Dec. 28, 2021

(54) IMAGE FORMING APPARATUS

(71) Applicant: CANON KABUSHIKI KAISHA, Tokyo (JP)

(72) Inventor: Shinkichi Yamamoto, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/018,052

(22) Filed: Sep. 11, 2020

(65) Prior Publication Data

US 2021/0080858 A1 Mar. 18, 2021

(30) Foreign Application Priority Data

Sep. 17, 2019 (JP) ..... JP2019-167918
Feb. 17, 2020 (JP) ..... JP2020-024679
Jul. 8, 2020 (JP) ..... JP2020-117616

(51) Int. Cl.
*G03G 15/08* (2006.01)
*G03G 21/18* (2006.01)

(52) U.S. Cl.
CPC ..... *G03G 15/0813* (2013.01); *G03G 21/1825* (2013.01)

(58) Field of Classification Search
CPC ..... G03G 15/0813; G03G 21/1821; G03G 21/1825
See application file for complete search history.

(56) References Cited

U.S. PATENT DOCUMENTS 4,851,873 A * 7/1989 Sakao ..... G03G 15/0855 399/119
5,019,867 A * 5/1991 Yamakawa ..... G03G 15/0896 399/119
10,095,180 B2 10/2018 Harada et al.
2007/0147890 A1* 6/2007 Hayakawa ..... G03G 15/0868 399/119
2013/0315635 A1* 11/2013 Funada ..... G03G 15/0921 399/269
2017/0261917 A1 9/2017 Harada et al.
(Continued)

FOREIGN PATENT DOCUMENTS

JP H05-134534 A 5/1993
JP 2017-161856 A 9/2017
(Continued)

*Primary Examiner* — Carla J Therrien
(74) *Attorney, Agent, or Firm* — Venable LLP

(57) ABSTRACT

An image forming apparatus includes a first urging member including a first end portion and a second end portion positioned on an opposite side of the first end portion, the first urging member configured to urge a first pressing member to a first pressing position, and a second urging member including a third end portion and a fourth end portion, the second urging member configured to urge a second pressing member to a second pressing position. The second end portion is arranged more distant from the first pressing member than the first end portion and is arranged between the first pressing member and the second pressing member in an axial direction, and the fourth end portion is arranged more distant from the second pressing member than the third end portion and is arranged between the first pressing member and the second pressing member in the axial direction.

20 Claims, 12 Drawing Sheets

(56) References Cited

U.S. PATENT DOCUMENTS

| | | | | |
|---|---|---|---|---|
| 2017/0261918 | A1* | 9/2017 | Zensai | G03G 21/1825 |
| 2017/0261920 | A1* | 9/2017 | Kawamura | G03G 21/1676 |
| 2021/0080897 | A1* | 3/2021 | Kawashima | G03G 21/1676 |

FOREIGN PATENT DOCUMENTS

| | | | |
|---|---|---|---|
| JP | 2017-167522 | A | 9/2017 |
| JP | 2017-167523 | A | 9/2017 |

* cited by examiner

IMAGE FORMING APPARATUS

BACKGROUND OF THE INVENTION

Field of the Invention

The present invention relates to an image forming apparatus for forming an image on a sheet.

Description of the Related Art

Hitherto, there has been proposed an image forming apparatus including a cartridge to which a drum serving as a photosensitive member, a developing unit including a developing roller and a cleaning unit for cleaning the drum are integrally assembled (refer to Japanese Patent Application Laid-Open Publication No. 2017-167523). The developing unit is urged by a contact/separation mechanism toward a direction approaching the drum, and the contact/separation mechanism includes a first pressing member and second pressing member, a slide member, a first spring, a second spring, a separation lever and a separation cam.

The first pressing member and the second pressing member are provided on respective end portions in an axial direction of the drum, and pressurizing surfaces of the first pressing member and the second pressing member are respectively urged by the first spring and the second spring toward a pressed portion of the developing unit. The first pressing member and the second pressing member are connected by the slide member, and when the separation lever connected to the slide member is pivoted by the separation cam, the slide member moves in sliding motion in the axial direction. Thereby, the first pressing member and the second pressing member pivot against the urging force of the first and second springs.

There are increasing demands for an image forming apparatus having a smaller size.

SUMMARY OF THE INVENTION

According to a first aspect of the present invention, an image forming apparatus includes a photosensitive member configured to be rotatable and bear an electrostatic latent image, a developing unit including a developing member configured to develop the electrostatic latent image by supplying developer to the photosensitive member, a first pressing member including a first pressing portion configured to press the developing unit such that the developing member approaches the photosensitive member, the first pressing member configured to move between a first pressing position in which the first pressing portion presses the developing unit and a first separation position in which the first pressing portion is separated from the developing unit, a second pressing member including a second pressing portion configured to press the developing unit such that the developing member approaches the photosensitive member, the second pressing member configured to move between a second pressing position in which the second pressing portion presses the developing unit and a second separation position in which the second pressing portion is separated from the developing unit, the second pressing member being arranged at a position different from the first pressing member in an axial direction of the photosensitive member, a moving unit configured to move in the axial direction so as to move the first pressing member and the second pressing member, a first urging member including a first end portion and a second end portion positioned on an opposite side of the first end portion, the first urging member configured to urge the first pressing member to the first pressing position, and a second urging member including a third end portion and a fourth end portion positioned on an opposite side of the third end portion, the second urging member configured to urge the second pressing member to the second pressing position, wherein the second end portion is arranged more distant from the first pressing member than the first end portion and is arranged between the first pressing member and the second pressing member in the axial direction, and the fourth end portion is arranged more distant from the second pressing member than the third end portion and is arranged between the first pressing member and the second pressing member in the axial direction.

According to a second aspect of the present invention, an image forming apparatus includes a photosensitive member configured to be rotatable and bear an electrostatic latent image, a developing unit including a developing member configured to develop the electrostatic latent image by supplying developer to the photosensitive member, a first pressing member including a first pressing portion configured to press the developing unit such that the developing member approaches the photosensitive member, the first pressing member configured to pivot around a first axis between a first pressing position in which the first pressing portion presses the developing unit and a first separation position in which the first pressing portion is separated from the developing unit, a second pressing member including a second pressing portion configured to press the developing unit such that the developing member approaches the photosensitive member, the second pressing member configured to pivot around a second axis parallel to the first axis between a second pressing position in which the second pressing portion presses the developing unit and a second separation position in which the second pressing portion is separated from the developing unit, the second pressing member being arranged at a position different from the first pressing member in an axial direction of the photosensitive member, and a moving unit configured to move in the axial direction so as to move the first pressing member and the second pressing member, wherein the first pressing member is configured to pivot in a first direction around the first axis when pivoting from the first pressing position to the first separation position, the second pressing member is configured to pivot in a second direction opposite to the first direction around the second axis when pivoting from the second pressing position to the second separation position, the first pressing portion is configured to move so as to approach the second axis in the axial direction in a case where the first pressing member pivots in the first direction around the first axis, and the second pressing portion is configured to move so as to approach the first axis in the axial direction in a case where the second pressing member pivots in the second direction around the second axis.

According to a third aspect of the present invention, an image forming apparatus includes a photosensitive member configured to be rotatable and bear an electrostatic latent image, a developing unit including a developing member configured to develop the electrostatic latent image by supplying developer to the photosensitive member, a first pressing member including a first pressing portion configured to press the developing unit such that the developing member approaches the photosensitive member, the first pressing member configured to move between a first pressing position in which the first pressing portion presses the developing unit and a first separation position in which the first pressing portion is separated from the developing unit, a second pressing member including a second pressing portion configured to press the developing unit such that the developing member approaches the photosensitive member, the second pressing member configured to move between a second pressing position in which the second pressing portion presses the developing unit and a second separation position in which the second pressing portion is separated from the developing unit, the second pressing member being arranged at a position different from the first pressing member in an axial direction of the photosensitive member, a first urging member including a first end portion and a second end portion positioned on an opposite side of the first end portion, the first urging member configured to urge the first pressing member to the first pressing position, and a second urging member including a third end portion and a fourth end portion positioned on an opposite side of the third end portion, the second urging member configured to urge the second pressing member to the second pressing position, wherein the first urging member is a tension spring, and the second urging member is a compression spring.

Further features of the present invention will become apparent from the following description of exemplary embodiments with reference to the attached drawings.

DESCRIPTION OF THE EMBODIMENTS

First Embodiment

Overall Configuration

Now, a first embodiment of the present invention will be described. A printer 1 serving as an image forming apparatus according to a first embodiment is a laser beam printer adopting an electrophotographic system. In the following description, a longitudinal direction LD (refer to FIG. 2B) of processing cartridges PY, PM, PC and PK is a direction parallel to an axial direction of a developing roller 5 serving as a developing member. Further, with respect to the longitudinal direction LD, a side of the processing cartridges PY, PM, PC and PK to which drive is transmitted from a printer body 1A is referred to as a drive side, i.e., back side of the body, and an opposite side thereof is referred to as a non-drive side, i.e., front side of the body.

Figure 1:
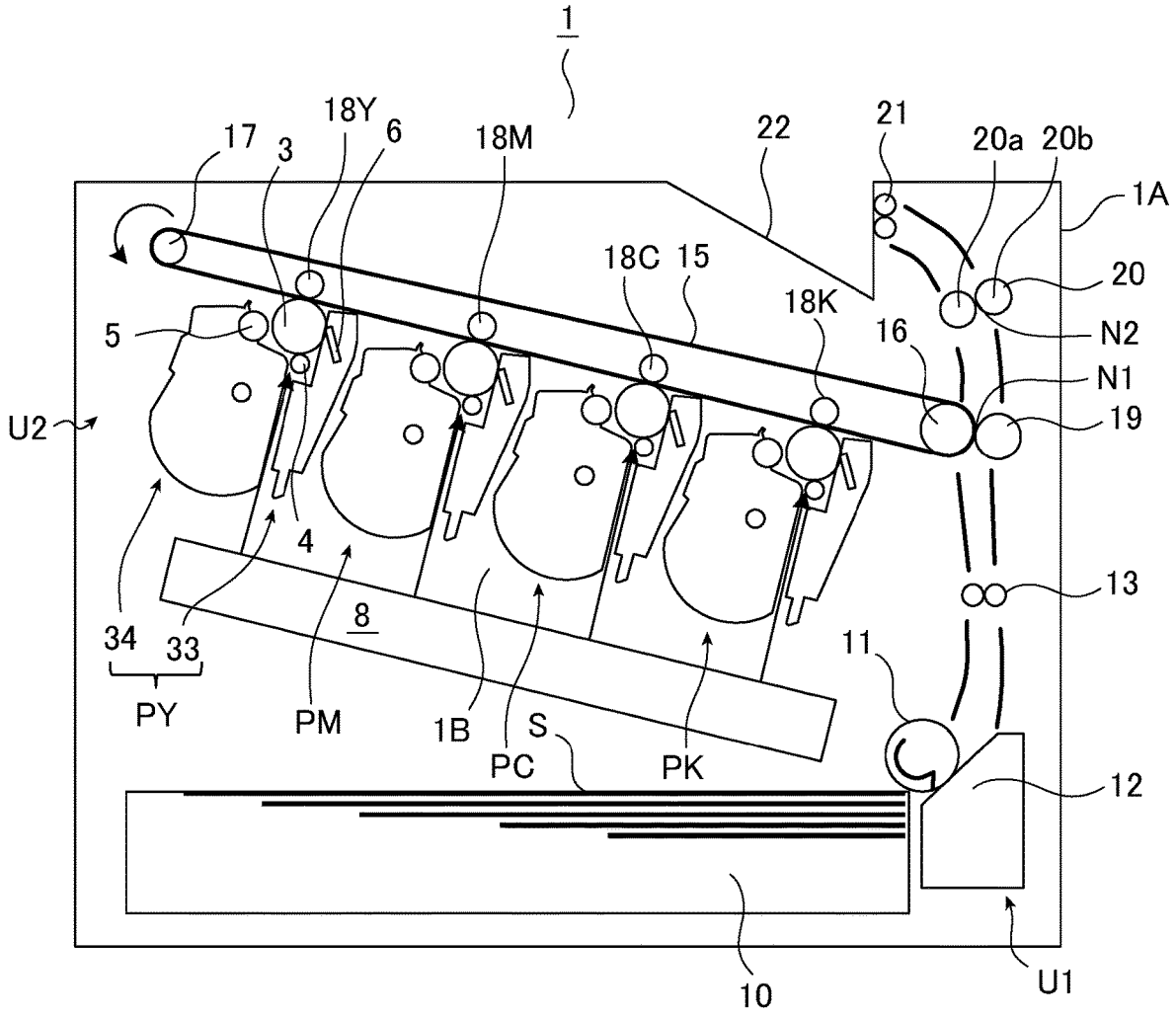
FIG. 1 is an entire schematic diagram illustrating a printer according to a first embodiment.

The printer 1 includes, as illustrated in FIG. 1, a sheet feed unit U1, an image forming unit U2, a fixing unit 20 and a sheet discharge roller pair 21. The image forming unit U2 includes four processing cartridges PY, PM, PC and PK that respectively form toner images of four colors of yellow (Y), magenta (M), cyan (C) and black (K), and a laser scanner 8.

The four processing cartridges PY, PM, PC and PK adopt the same configuration except for the difference in the colors of the images being formed. Therefore, the configuration and image forming process of only the processing cartridge PY will be described, and the descriptions of other processing cartridges PM, PC and PK will be omitted.

The processing cartridge PY includes a photosensitive member unit 33 and a developing unit 34. The photosensitive member unit 33 includes a photosensitive drum 3 serving as a photosensitive member that is supported rotatably and bears an electrostatic latent image, a charge roller 4 and a cleaning blade 6. The developing unit 34 includes a developing roller 5 serving as a developing member for developing the electrostatic latent image on the photosensitive drum 3 by supplying developer to the photosensitive drum 3.

An intermediate transfer belt 15 serving as an intermediate transfer body wound around a drive roller 16 and a tension roller 17 is provided in the image forming unit U2. Further, primary transfer rollers 18Y, 18M, 18C and 18K serving as transfer portions are provided on an inner side of the intermediate transfer belt 15. A secondary transfer roller 19 is provided to oppose to the drive roller 16 interposing the intermediate transfer belt 15, wherein the intermediate transfer belt 15 and the secondary transfer roller 19 form a secondary transfer portion N1 serving as an image forming portion for transferring an image onto a sheet S being conveyed.

The sheet feed unit U1 includes a cassette 10 storing sheets S, a pickup roller 11 for feeding the sheets S stored in the cassette 10, and a separation unit 12 working with the pickup roller 11 for separating sheets one at a time. The fixing unit 20 includes a fixing roller 20*a* having a heater not shown embedded therein and a pressure roller 20*b* being in pressure contact with the fixing roller 20*a*, wherein heat and pressure are applied to the sheet S at a fixing portion N2 formed by the fixing roller 20*a* and the pressure roller 20*b*.

Next, an image forming operation of the printer 1 adopting the above-described configuration will be described. When an image signal is entered to the laser scanner 8 from a personal computer and the like not shown, a laser beam corresponding to an image signal is irradiated on the photosensitive drum 3 of the processing cartridge PY from the laser scanner 8. In this state, the surface of the photosensitive drum 3 is uniformly charged to a predetermined polarity and potential in advance by a charge roller 4, and an electrostatic latent image is formed on the surface by irradiating laser beams from the laser scanner 8. The electrostatic latent image formed on the photosensitive drum 3 is developed by the developing roller 5, and a yellow (Y) toner image is formed on the photosensitive drum 3.

Similarly, laser beams are irradiated from the laser scanner 8 to respective photosensitive drums of the processing cartridges PM, PC and PK, and toner images of magenta (M), cyan (C) and black (K) are formed on the respective photosensitive drums. The toner images of respective colors formed on the photosensitive drums are transferred by the primary transfer rollers 18Y, 18M, 18C and 18K to the intermediate transfer belt 15, and conveyed on the intermediate transfer belt 15 rotated by the drive roller 16 to the secondary transfer portion N1. The image forming processes of respective colors are performed at a timing to superpose the toner image on a toner image primarily transferred upstream on the intermediate transfer belt 15. The toner remaining on the photosensitive drum 3 after toner image has been transferred by the primary transfer roller 18Y is collected by the cleaning blade 6.

In parallel with the image forming process, the sheet S stored in the cassette 10 is fed by the pickup roller 11. The sheet S fed by the pickup roller 11 is separated one at a time by the separation unit 12. It is also possible to separate the sheet one at a time by a separation pad or a separation roller opposed to the pickup roller 11 instead of the separation unit 12.

The sheet S abuts against a nip portion of a registration roller pair 13 in a stopped state and the leading edge of the sheet S is aligned with the nip portion, by which the skewing of the sheet S is corrected. The registration roller pair 13 is started to be driven at a matched timing with the toner image borne on the intermediate transfer belt 15, and the sheet S is conveyed toward the secondary transfer portion N1.

A full-color toner image on the intermediate transfer belt 15 is transferred at the secondary transfer portion N1 by secondary transfer bias applied to the secondary transfer roller 19. The toner remaining on the intermediate transfer belt 15 is cleaned by a cleaning device not shown. Predetermined heat and pressure are applied at the fixing portion N2 to the sheet S to which toner image has been transferred, and the toner is melted and fixed thereto. The sheet S having passed through the fixing portion N2 is discharged to a sheet discharge tray 22 by the sheet discharge roller pair 21.

Processing Cartridge

Figure 2A:
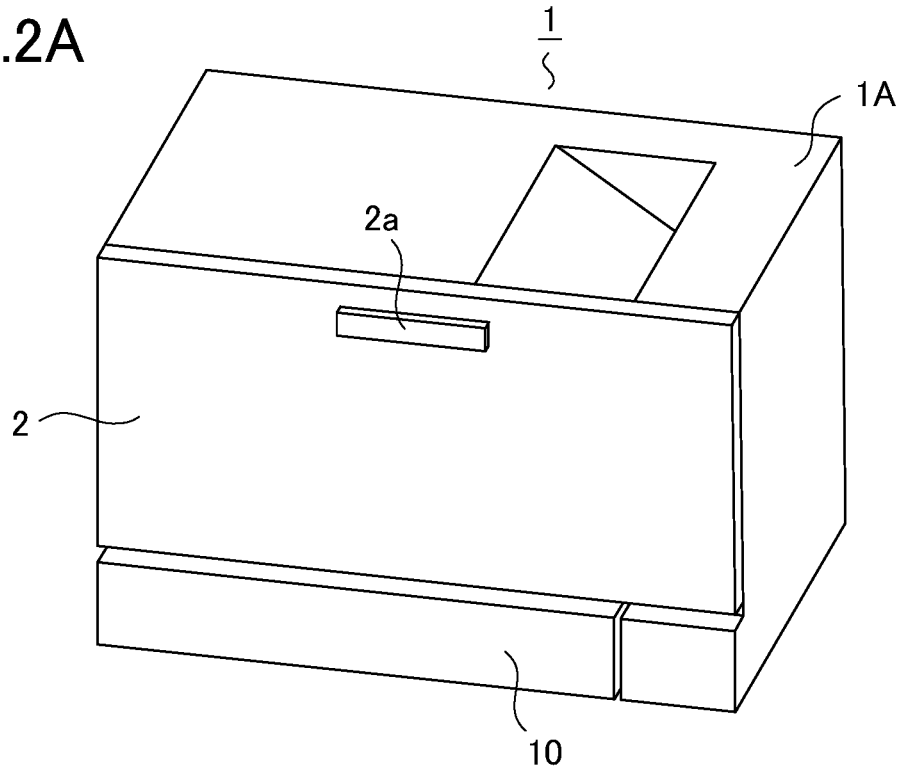
FIG. 2A is a perspective view illustrating a printer.
Figure 2B:
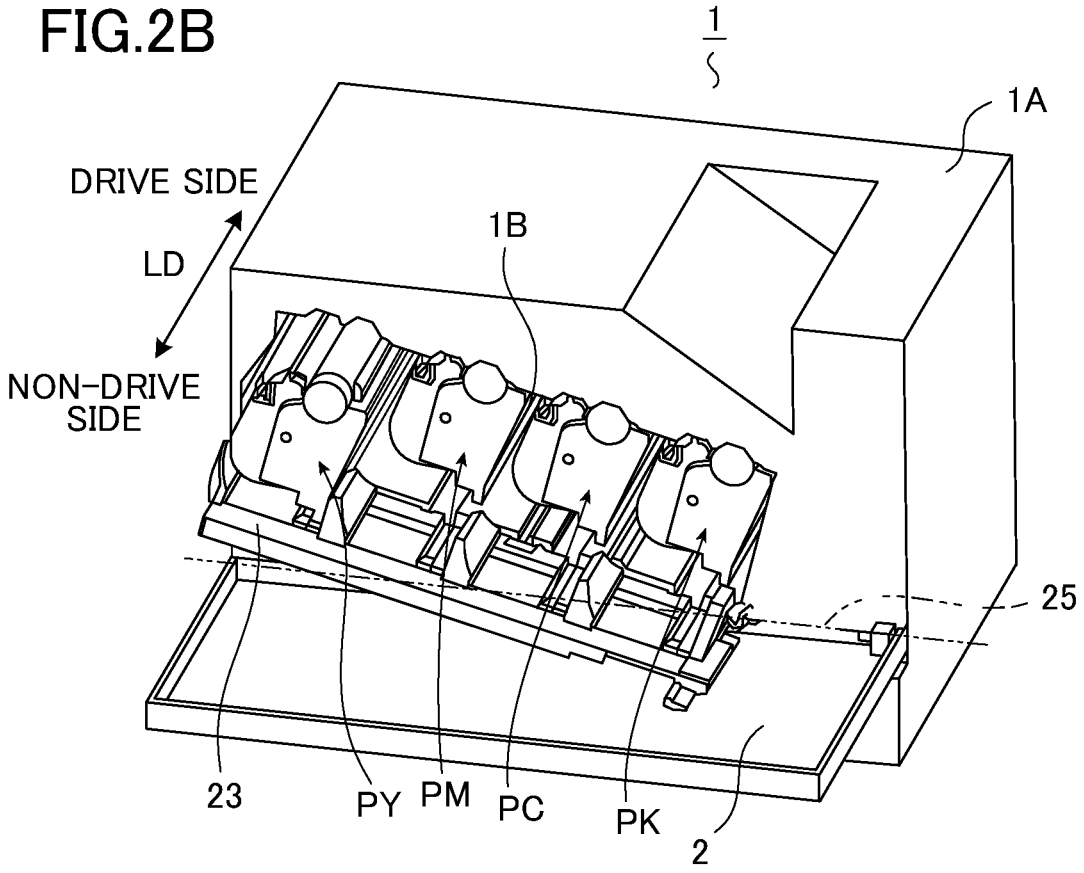
FIG. 2B is a perspective view illustrating a storage portion in which a process cartridge is stored.

As illustrated in FIGS. 2A and 2B, the printer 1 includes a front door 2 supported on the printer body 1A in an openable/closable manner around a rotation shaft 25, and the front door 2 has a grip portion 2*a* provided on a front side of the apparatus. The user opens the front door 2 by gripping the grip portion 2*a*. The front door 2 further includes a cartridge door 23 that opens and closes in linkage with the front door 2, and when the cartridge door 23 is opened, a storage portion 1B storing the processing cartridges PY, PM, PC and PK is exposed.

The respective processing cartridges PY, PM, PC and PK are attached detachably in a longitudinal direction LD corresponding to an axial direction of the photosensitive drum 3 independently from the storage portion 1B. Further, in a state where the respective processing cartridges PY, PM, PC and PK are attached to the storage portion 1B, drive from the printer body 1A can be transmitted to the respective processing cartridges PY, PM, PC and PK.

Figure 3A:
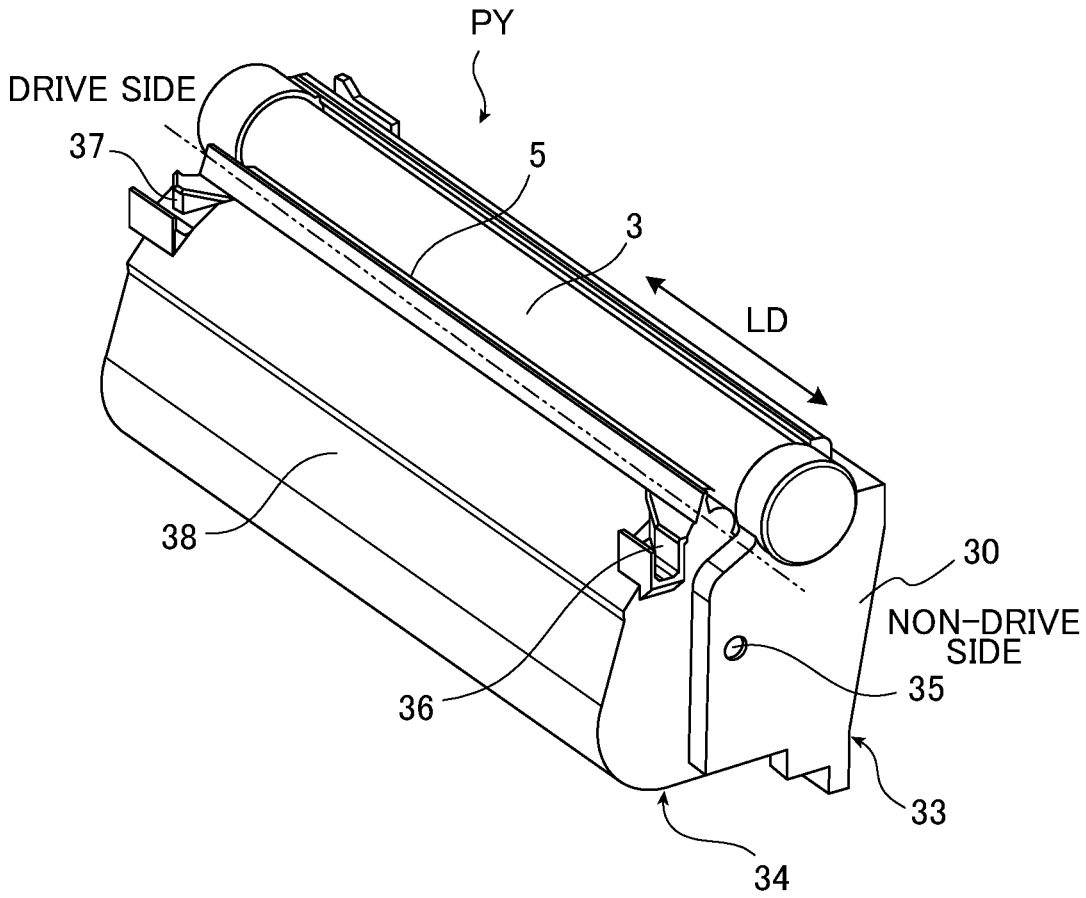
FIG. 3A is a perspective view illustrating a processing cartridge.
Figure 3B:
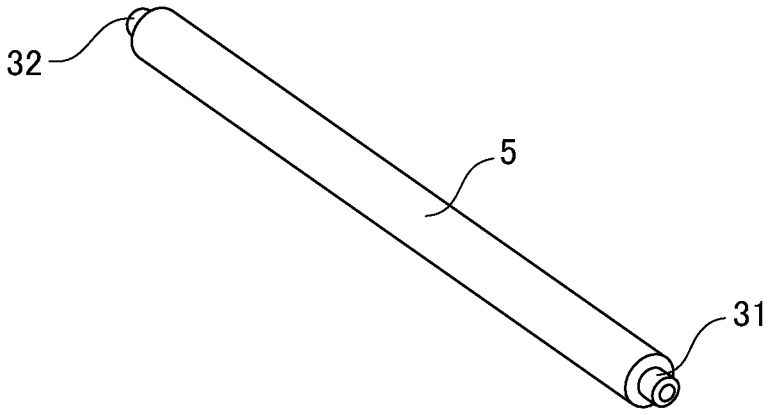
FIG. 3B is a perspective view illustrating a developing roller.

The processing cartridge PY includes the photosensitive member unit 33 and the developing unit 34, as illustrated in FIG. 3A, wherein the developing unit 34 is supported rotatably around a center of rotation 35 on a frame body 30 of the photosensitive member unit 33. The developing roller 5 is stored in a developing unit frame 38 of the developing unit 34, and the developing roller 5 is supported rotatably by bearing members 31 and 32 arranged on non-drive side and drive side end portions of the developing unit frame 38, as shown in FIG. 3B.

Further, the developing unit frame 38 includes pressed portions 36 and 37 respectively arranged on the non-drive side and the drive side end portions, and in a state where the pressed portions 36 and 37 are pressed by a pressing unit 40 described later, the developing roller 5 is positioned on the photosensitive drum 3. Thereby, the distance between the developing roller 5 and the photosensitive drum 3 is defined. The pressed portions 36 and 37 are arranged approximately at the same position as bearing members 31 and 32 serving as first and second bearing members in the longitudinal direction LD. In other words, the positions of the pressed portions 36 and 37 and the positions of the bearing members 31 and 32 serving as first and second bearing members at least partially overlap in the longitudinal direction LD. That is, the pressed portion 36 and a pressing portion 50*b* described later are overlapped with the bearing member 31 and the pressed portion 37 and a pressing portion 51*b* described later are overlapped with the bearing member 32 in the longitudinal direction LD. Therefore, the pressed portion 36 and the pressing portion 50*b* described later are overlapped with the bearing member 31 and the pressed portion 37 and the pressing portion 51*b* described later are overlapped with the bearing member 32 when viewed in a direction orthogonal to the longitudinal direction LD.

The pressed portions 36 and 37 can transmit pressing force received from the pressing unit 40 to the developing roller 5 without loss, so there is no need to reinforce the developing unit frame 38. Thereby, the developing unit frame 38 can be downsized and formed at a low cost.

Figure 4:
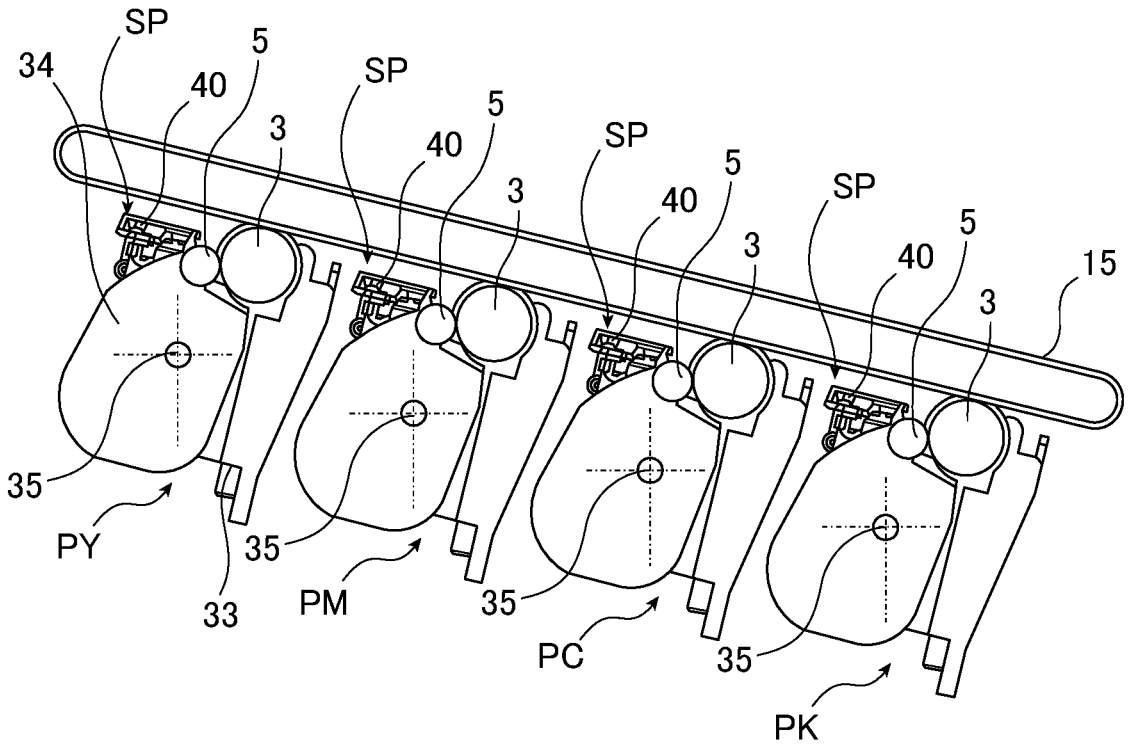
FIG. 4 is a cross-sectional view illustrating the respective processing cartridges and pressing units.

Further, as illustrated in FIG. 4, the processing cartridges PY, PM, PC and PK each include one pressing unit 40. In the following description, only the pressing unit 40 capable of pressing the developing unit 34 of the processing cartridge PY will be described, and the description of other pressing units will be omitted. The pressing unit 40 is stored in a space SP surrounded by the intermediate transfer belt 15 and respective processing cartridges PY, PM, PC and PK.

In the present embodiment, the pressing unit 40 is configured to press the pressed portions 36 and 37 positioned on an upper portion of the developing unit frame 38, that is, the developing unit 34. More specifically, as illustrated FIG. 4, the pressing unit 40 is positioned on an upper side of the center of rotation 35 of the developing unit 34 in a vertical direction. The photosensitive drum 3 is arranged on one side of a vertical line that passes the center of rotation 35 and the pressing unit 40 is arranged on the other side thereof with respect to a horizontal direction. Even further, the pressing unit 40 is positioned upstream of the developing roller 5 and the photosensitive drum 3 with respect to a direction of movement (direction of arrow in FIG. 1) of the intermediate transfer belt 15 on a side in contact with the photosensitive drum 3. Therefore, compared to a case where the pressing unit 40 is arranged below the processing cartridge PY, for example, the pressing unit 40 can be arranged in a space-saving manner, and the apparatus can be downsized.

The pressing unit 40 and the processing cartridge PY must be small in order to store the pressing unit 40 in the space SP. For example, if the pressing unit 40 presses the area other than the pressed portions 36 and 37 arranged at positions corresponding to the bearing members 31 and 32 of the developing roller 5 in the longitudinal direction LD, the developing unit frame 38 must be reinforced. However, if the developing unit frame 38 is reinforced, the size of the processing cartridge PY will be increased, and it becomes difficult to store the pressing unit 40 in the space SP.

If the developing unit frame 38 is not reinforced, the pressing force of the pressing unit 40 must be suppressed in response to the stiffness of the developing unit frame 38, and the developing roller 5 cannot be urged by appropriate force toward the photosensitive drum 3.

Pressing Unit

Next, the configuration of the pressing unit 40 will be described in detail. The pressing unit 40 includes a first pressing member 50, a second pressing member 51 and slide members 52F and 52B, as illustrated in FIGS. 5A to 5D. Further, the pressing unit 40 includes a first spring 53F, a second spring 53B, a first slide plate 54, a second slide plate 55, a center cam 56, a separation cam 57 and a cam gear 58. These respective members of the pressing unit 40 is supported on a pressing stay 500 fixed to the printer body 1A.

The first pressing member 50 is supported pivotably around a pivot shaft 50*a* serving as a first axis on the pressing stay 500 and includes a pressing portion 50*b* serving as a first pressing portion protruded downward. The pressing portion 50*b* passes downward through an approximately fan-shaped hole formed on the pressing stay 500 and presses the pressed portion 36 (refer to FIG. 3A) serving as a first pressed portion of the developing unit frame 38 such that the developing roller 5 approaches the photosensitive drum 3.

The first pressing member 50 is movable between a contact position serving as a first pressing position where the pressing portion 50*b* presses the pressed portion 36 of the developing unit frame 38 and a separation position serving as a first separation position where the pressing portion 50*b* separates from the pressed portion 36. Further, the first pressing member 50 is connected to a slide member 52F at a connection portion 50*c*, and the slide member 52F is urged by the first spring 53F serving as a first urging member composed of a compression spring. The first spring 53F includes a first end portion 53F1 and a second end portion 53F2 on an opposite side of the first end portion 53F1. More specifically, the second end portion 53F2 is arranged on an opposite side of the first end portion 53F1 in a direction of deformation of the first spring 53F, and is positioned on an inner side of the first end portion 53F1 with respect to the longitudinal direction LD. Further, the second end portion 53F2 is arranged at a position more distant from the first pressing member 50 than the first end portion 53F1. The first end portion 53F1 presses the first pressing member 50 through the slide member 52F. The second end portion 53F2 is supported by the pressing stay 500.

Similarly, the second pressing member 51 is supported pivotably around a pivot shaft 51*a* serving as a second axis on the pressing stay 500 and includes a pressing portion 51*b* serving as a second pressing portion protruded downward. The pressing portion 51*b* passes downward through an approximately fan-shaped hole formed on the pressing stay 500 and presses the pressed portion 37 (refer to FIG. 3A) serving as a second pressed portion of the developing unit frame 38 such that the developing roller 5 approaches the photosensitive drum 3.

The second pressing member 51 is movable between a contact position serving as a second pressing position where the pressing portion 51*b* presses the pressed portion 37 of the developing unit frame 38 and a separation position serving as a second separation position where the pressing portion 51*b* separates from the pressed portion 37. Further, the second pressing member 51 is connected to a slide member 52B at a connection portion 51*c*, and the slide member 52B is urged by the second spring 53B serving as a second urging member composed of a compression spring. The second spring 53B includes a third end portion 53B1 and a fourth end portion 53B2 on an opposite side of the third end portion 53B1. More specifically, the fourth end portion 53B2 is arranged on an opposite side of the third end portion 53B1 in a direction of deformation of the second spring 53B, and is positioned on an inner side of the third end portion 53B1 in the longitudinal direction LD. Further, the fourth end portion 53B2 is positioned at a position more distant from the second pressing member 51 than the third end portion 53B1. The third end portion 53B1 presses the second pressing member 51 through the slide member 52B. The fourth end portion 53B2 is supported on the pressing stay 500.

The first pressing member 50 and the second pressing member 51 are arranged on both end portions of the pressing unit 40 in the longitudinal direction LD. That is, the first pressing member 50 and the second pressing member 51 are arranged at mutually different positions in the longitudinal direction LD. All of the first spring 53F, the second spring 53B and the slide members 52F and 52B are arranged between the first pressing member 50 and the second pressing member 51 in the longitudinal direction LD. In other words, the second end portion 53F2 is arranged between the first pressing member 50 and the second pressing member 51, that is, on the inner side of the first pressing member 50 and the second pressing member 51, in the longitudinal direction LD. The fourth end portion 53B2 is arranged between the first pressing member 50 and the second pressing member 51, that is, on the inner side of the first pressing member 50 and the second pressing member 51, in the longitudinal direction LD.

Further, the cam gear 58 is arranged on the drive side end portion of the pressing unit 40, and the cam gear 58 rotates by driving force of a drive motor M provided on the printer body 1A (refer to FIG. 1). The separation cam 57 serving as a driving member is arranged adjacent to the cam gear 58 and supported pivotably around a pivot shaft 57*a* on the pressing stay 500. The separation cam 57 pivots around the pivot shaft 57*a* when pressed by a cam portion 58*a* of the cam gear 58.

The separation cam 57 is connected to the second slide plate 55 at a connection portion 57*b*, and the second slide plate 55 is connected to the center cam 56 at a connection portion 55*a*. The center cam 56 is supported rotatably around a center of rotation 56*a* on the pressing stay 500, and a connection portion 54*a* connected to the first slide plate 54 is provided on an opposite side of the connection portion 55*a* interposing the center of rotation 56*a* of the center cam 56.

As described, the first slide plate 54 and the second slide plate 55 are connected via the center cam 56 serving as an interlocking unit so that they are moved in linkage with each other toward opposite directions in the longitudinal direction LD. The second slide plate 55 serving as a second moving member is engaged with the second pressing member 51 at an engagement portion 55*b*, and the first slide plate 54 serving as a first moving member is engaged with the first pressing member 50 at an engagement portion 54*b*. The first slide plate 54 and the second slide plate 55 constitute a moving unit 545 that moves the first pressing member 50 and the second pressing member 51. In other words, the moving unit 545 includes the first slide plate 54 and the second slide plate 55. If the movement of the first pressing member 50 and the second pressing member 51 is performed using a member having a rotation shaft parallel to the longitudinal direction LD, a space for allowing movement of the member is required in a direction orthogonal to the longitudinal direction LD. In contract, since the first pressing member 50 and the second pressing member 51 are moved by the first slide plate 54 and the second slide plate 55 moving in the longitudinal direction LD, the apparatus can be downsized in the direction orthogonal to the longitudinal direction LD.

Contact/Separation Operation

Figure 5A:
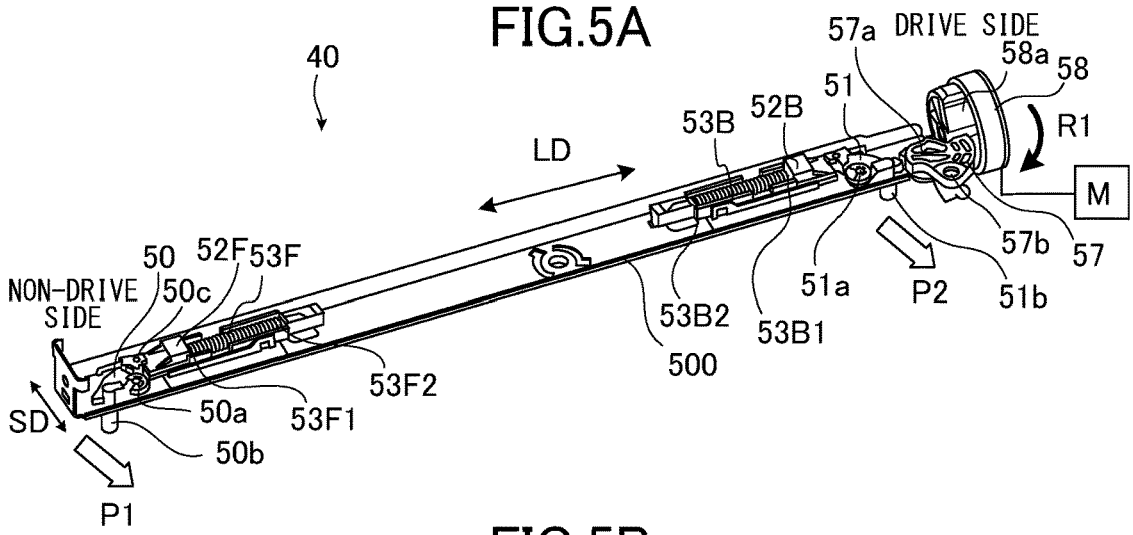
FIG. 5A is a perspective view illustrating a pressing unit.
Figure 5B:
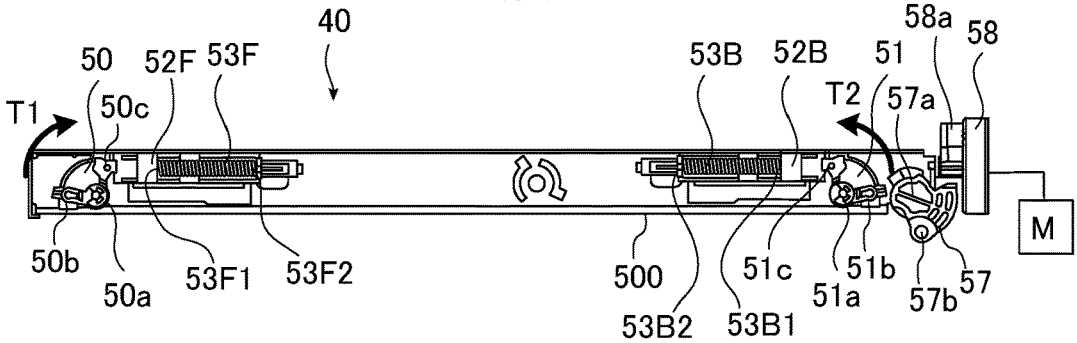
FIG. 5B is a plan view illustrating the pressing unit.
Figure 5C:
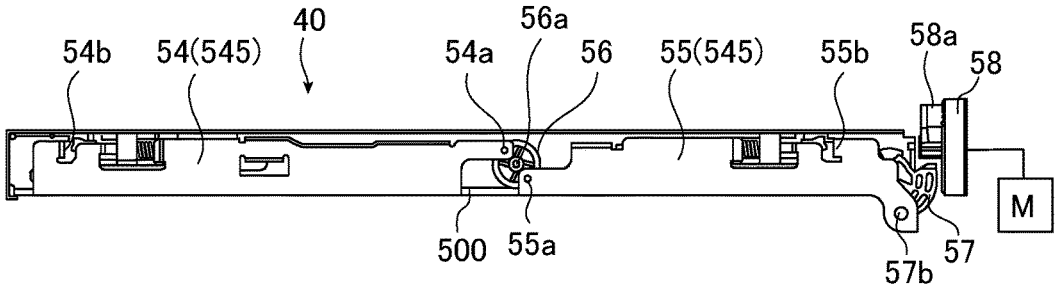
FIG. 5C is a plan view illustrating a first slide plate and a second slide plate of the pressing unit.

Next, a contact/separation operation where the pressing portion 50*b* of the first pressing member 50 and the pressing portion 51*b* of the second pressing member 51 are respectively moved to contact or separate from the pressed portions 36 and 37 of the developing unit frame 38 will be described. When the pressing portion 50*b* of the first pressing member 50 and the pressing portion 51*b* of the second pressing member 51 contact the pressed portions 36 and 37, the drive motor M is stopped and the cam gear 58 is positioned at the contact position, as illustrated in FIGS. 5A to 5C. In this state, the cam portion 58*a* of the cam gear 58 is separated from the separation cam 57.

In this state, the slide members 52F and 52B are urged by the first spring 53F and the second spring 53B toward a direction separating from the center cam 56 in the longitudinal direction LD. The first pressing member 50 pivots around the pivot shaft 50*a* when pressed by the slide member 52F, and the pressing portion 50*b* of the first pressing member 50 presses the pressed portion 36 (refer to FIG. 3A) of the developing unit frame 38 with pressing force P1 shown in FIG. 5A.

Further, the second pressing member 51 pivots around the pivot shaft 51*a* when pressed by the slide member 52B, and the pressing portion 51*b* of the second pressing member 51 presses the pressed portion 37 (refer to FIG. 3A) of the developing unit frame 38 with pressing force P2 illustrated in FIG. 5A. The pressing forces P1 and P2 are forces along the short direction SD orthogonal to the longitudinal direction LD.

The pressed portions 36 and 37 are respectively pressed by the pressing portions 50*b* and 51*b*, by which the developing unit 34 is displaced, and the developing roller 5 is displaced with respect to the photosensitive drum 3. In the present embodiment, the pressed portions 36 and 37 are pressed by the pressing portions 50*b* and 51*b*, by which the developing roller 5 contacts the photosensitive drum 3. The processing cartridge PY may adopt a configuration where the developing roller 5 and the photosensitive drum 3 of the developing unit 34 are opposed to each other with a predetermined gap therebetween in a state where the pressed portions 36 and 37 are pressed by the pressing portions 50*b* and 51*b*. As a result, the electrostatic latent image on the photosensitive drum 3 can be developed highly accurately.

Figure 5D:
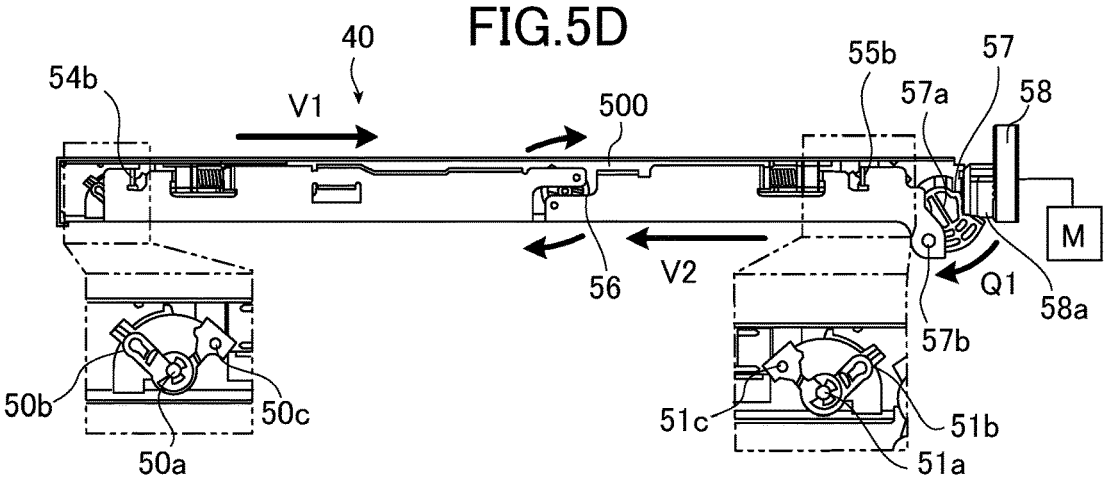
FIG. 5D is a plan view illustrating a separation operation of the pressing unit.

Next, the separation operation of the first pressing member 50 and the second pressing member 51 will be descried. For example, when the image forming operation is completed, the drive motor M is driven and the cam gear 58 rotates in the direction of arrow R1, as illustrated in FIG. 5A. It is also possible to adopt a configuration where the drive motor M is driven to rotate the cam gear 58 in the direction of arrow R1, as illustrated in FIG. 5A, when the front door 2 or the cartridge door 23 is opened. Then, the cam portion 58*a* of the cam gear 58 pivots the separation cam 57 in the direction of arrow Q1, as illustrated in FIG. 5D. The drive motor M and the cam gear 58 are stopped at the position illustrated in FIG. 5D until the front door 2 or the cartridge door 23 is closed.

The second slide plate 55 moves in sliding motion toward the direction of arrow V2 by the separation cam 57 pivoting in the direction of arrow Q1, and the first slide plate 54 moves in sliding motion by the operation of the center cam 56 toward the direction of arrow V1 opposite to the direction of arrow V2. Directions of arrow V1 and arrow V2 are parallel to the longitudinal direction LD.

In this state, the second slide plate 55 presses the second pressing member 51 against the urging force of the second spring 53B, and the second pressing member 51 pivots around the pivot shaft 51*a* in a second direction T2 illustrated in FIG. 5B. Thereby, the second pressing member 51 is positioned at the separation position illustrated by the broken line of FIG. 5D.

Similarly, a first slide plate 55 presses the first pressing member 50 against the urging force of the first spring 53F, and the first pressing member 50 pivots around the pivot shaft 50*a* in a first direction T1 illustrated in FIG. 5B. The second direction T2 is opposite to the first direction T1. Thereby, the first pressing member 50 is positioned at the separation position illustrated by the broken line of FIG. 5D.

As described, by positioning the first pressing member 50 and the second pressing member 51 at the separation position, a contact state of the developing roller 5 to the photosensitive drum 3 is cancelled, so that the damage caused to the developing roller 5 and the photosensitive drum 3 during attachment and detachment of the processing cartridge PY can be reduced. In a state where the attachment/detachment operation of the processing cartridge PY is completed and the image forming operation is performed, the drive motor M is driven and the cam gear 58 moves to the contact position. It is also possible to adopt a configuration where the drive motor M is driven to move the cam gear 58 to the contact position when the front door 2 or the cartridge door 23 is closed. Thereby, the developing roller 5 is in a contact state where it is pressed against the photosensitive drum 3.

Figure 6A:
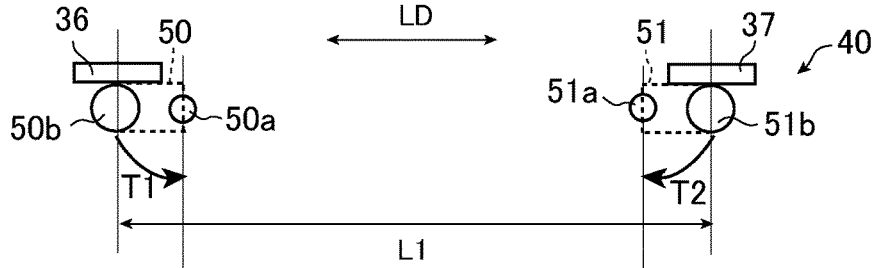
FIG. 6A is a schematic diagram illustrating a state where a first pressing member and a second pressing member are positioned at a contact position.
Figure 6B:
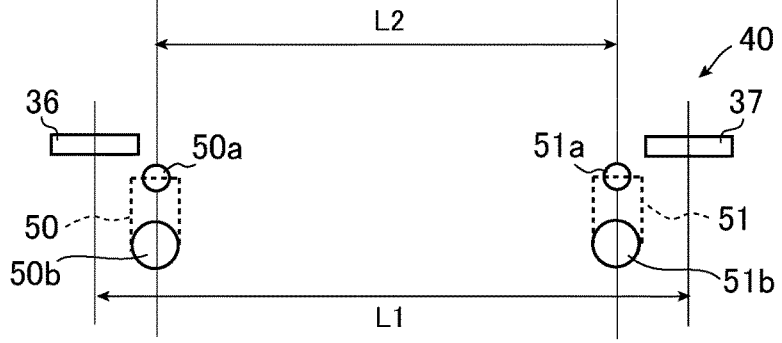
FIG. 6B is a schematic diagram illustrating a state where the first pressing member and the second pressing member are positioned at a separation position.

Now, a relevant portion of the present embodiment will be described in detail with reference to FIGS. 6A to 6D. FIGS. 6A and 6B are schematic diagrams illustrating the operation of the pressing unit 40 according to the present embodiment, and FIGS. 6C and 6D are schematic diagrams illustrating the operation of a pressing unit 540 according to a comparative example.

As illustrated in FIG. 6A, the pressing portions 50*b* and 51*b* press the pressed portions 36 and 37 of the developing unit frame 38 (refer to FIG. 3A) when the first pressing member 50 and the second pressing member 51 are respectively positioned at the contact positions. Further, as illustrated in FIG. 6B, the pressing portions 50*b* and 51*b* are separated from the pressed portions 36 and 37 of the developing unit frame 38 (refer to FIG. 3A) when the first pressing member 50 and the second pressing member 51 are respectively positioned at the separation positions.

The length of the developing unit frame 38 in the longitudinal direction LD is set to length L1, and as described above, it is difficult to shorten the length L1 without reinforcement of the developing unit frame 38. More specifically, length L1 corresponds to the distance between the position in which the pressed portion 36 is pressed and the position in which the pressed portion 37 is pressed. The size of the developing unit 34 and the developing unit frame 38 in the longitudinal direction LD is determined to a certain extent by the size of the sheet S to which the printer 1 corresponds. Meanwhile, the length L1 should preferably be as long as possible for the developing unit 34 to be pressed stably. Therefore, the pressed portion 36 and the pressed portion 37 should preferably be positioned near both end portions of the developing unit 34 in the longitudinal direction LD. Therefore, in order to correspond to sheets S having predetermined sizes, the length L1 should preferably be set as long as possible within the scope of the size required by the developing unit 34. On the other hand, the pressing unit 40 should preferably fit within length L1 for downsizing the apparatus.

Figure 6C:
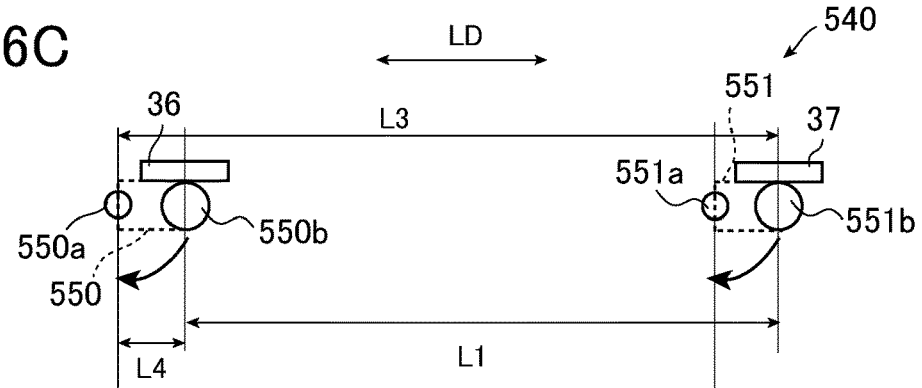
FIG. 6C is a schematic diagram illustrating a pressing unit according to a comparative example.
Figure 6D:
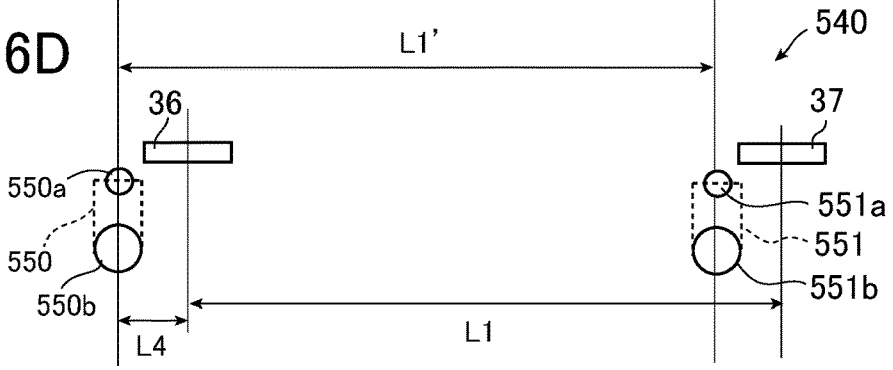
FIG. 6D is a schematic diagram illustrating a state where a first pressing member and a second pressing member of the pressing unit according to the comparative example is positioned at a separation position.

According to the pressing unit 540 of the comparative example, as illustrated in FIG. 6C, the pivoting directions of the first pressing member 550 and the second pressing member 551 are the same direction. When the first pressing member 550 and the second pressing member 551 are positioned at the contact position, a pivot shaft 550*a* of the first pressing member 550 and a pressing portion 551*b* of the second pressing member 551 are positioned at the outermost sides of the pressing unit 540 in the longitudinal direction LD. The distance between the pivot shaft 550*a* and the pressing portion 551*b* in the longitudinal direction LD is set to length L3.

Further, as illustrated in FIG. 6D, when the first pressing member 550 and the second pressing member 551 are positioned at the separation position, pressing portions 550*b* and 551*b* or pivot shafts 550*a* and 551*a* are positioned at the outermost sides of the pressing unit 540 in the longitudinal direction LD. The distance between the pressing portions 550*b* and 551*b* in the longitudinal direction LD is set to length L1' that is equivalent to length L1.

According to the pressing unit 540 of the comparative example, the first pressing member 550 and the second pressing member 551 are protruded outward in the longitudinal direction LD for length L4 from the pressed portion 36 at both the contact position and the separation position. Therefore, the pressing unit 540 does not fit within the length L1 between the pressed portions 36 and 37 of the developing unit frame 38 and the apparatus is increased in size in the longitudinal direction LD.

Meanwhile, the pivoting directions of the first pressing member 50 and the second 51 of the pressing unit 40 according to the present embodiment are mutually opposite during the contact/separation operation. That is, the first pressing member 50 pivots in the first direction T1 when pivoting from the contact position to the separation position, and the second pressing member 51 pivots in the second direction T2 when pivoting from the contact position to the separation position.

As illustrated in FIG. 6A, in a state where the first pressing member 50 and the second pressing member 51 are positioned at the contact position, the pressing portions 50*b* and 51*b* are positioned at outermost sides of the pressing unit 40 in the longitudinal direction LD. In other words, the pressing portion 50*b* is positioned farther from the pivot shaft 51*a* than the pivot shaft 50*a* in the longitudinal direction LD, and the pressing portion 51*b* is positioned farther from the pivot shaft 50*a* than the pivot shaft 51*a* in the longitudinal direction LD. Then, the distance between the pressing portions 50*b* and 51*b* is equivalent to length L1.

Further, as illustrated in FIG. 6B, the pressing portions 50*b* and 51*b* pivot inward in the longitudinal direction LD when the first pressing member 50 and the second pressing member 51 move from the contact position to the separation position. That is, the pressing portion 50*b* of the first pressing member 50 moves so as to approach the pivot shaft 51*a* in the longitudinal direction LD, and the pressing portion 51*b* of the second pressing member 51 moves so as to approach the pivot shaft 50*a* in the longitudinal direction LD. When the first pressing member 50 and the second pressing member 51 are positioned at the separation position, the pressing portions 50*b* and 51*b* or the pivot shafts 50*a* and 51*a* are positioned on outermost sides of the pressing unit 40 in the longitudinal direction LD. The distance between the pressing portions 50*b* and 51*b* in the longitudinal direction LD is set to a length L2 shorter than the length L1.

As described, according to the present embodiment, regardless of whether the first pressing member 50 and the second pressing member 51 are positioned at the contact position or the separation position, the pressing unit 40 fits within the length L1 which is the distance between the pressed portions 36 and 37. Further, the pressing unit 40 is not protruded outward of the pressed portions 36 and 37 in the longitudinal direction LD. Therefore, the apparatus including the pressing unit 40 can be downsized in the longitudinal direction LD.

Modified Example

Figure 7A:
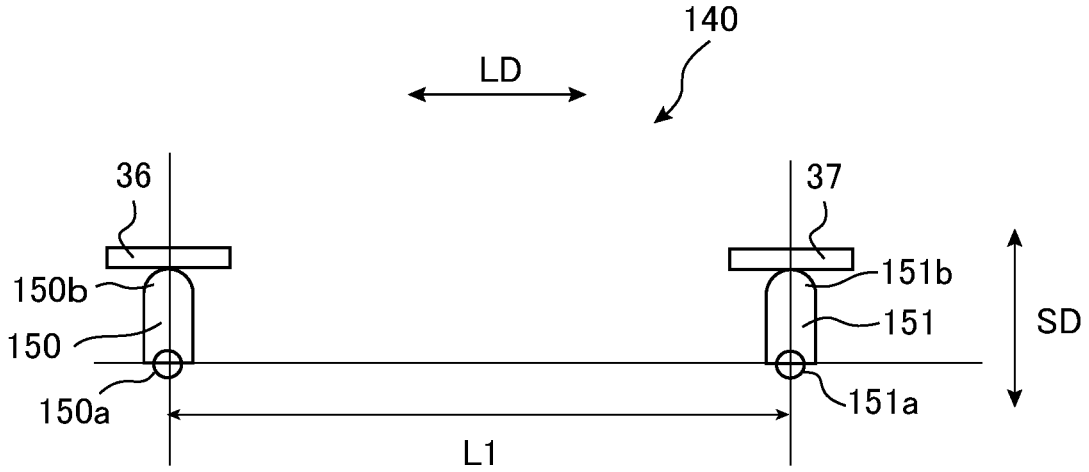
FIG. 7A is a schematic diagram illustrating a pressing unit according to a modified example.

Next, a modified example according to the present embodiment will be described with reference to FIGS. 7A and 7B. As illustrated in FIG. 7A, pivoting directions of a first pressing member 150 and a second pressing member 151 of a pressing unit 140 according to a modified example of the present embodiment are mutually opposite during the contact/separation operation.

When the first pressing member 150 and the second pressing member 151 are positioned at the contact position, pressing portions 150*b* and 151*b* are extended from pivot shafts 150*a* and 151*a* along a short direction SD orthogonal to the longitudinal direction LD. In other words, a straight line passing the pivot shaft 150*a* and the abutment portion of the pressing portion 150*b* and the pressed portion 36 or a straight line passing the pivot shaft 151*a* and the abutment portion of the pressing portion 151*b* and the pressed portion 37 is orthogonal to the longitudinal direction LD.

When the first pressing member 150 and the second pressing member 151 are positioned at the contact position, the pressing portions 150*b* and 151*b* or the pivot shafts 150*a* and 151*a* are positioned at the outermost sides of the pressing unit 140 in the longitudinal direction LD. The distance between the pressing portions 150*b* and 151*b* in the longitudinal direction LD is set to length L1.

Figure 7B:
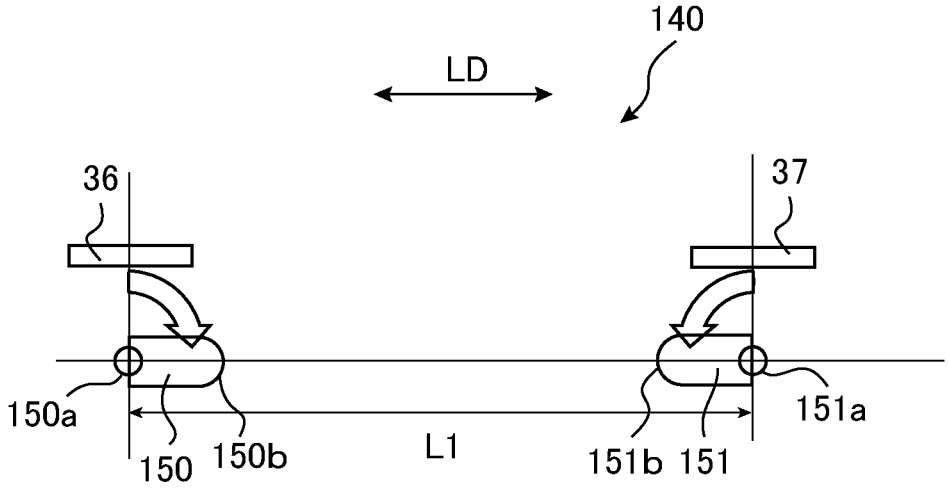
FIG. 7B is a schematic diagram illustrating a state where a first pressing member and a second pressing member of the pressing unit according to the modified example are positioned at a separation position.

As illustrated in FIG. 7B, the first pressing member 150 and the second pressing member 151 pivot inward in the longitudinal direction LD when moving from the contact position to the separation position. When the first pressing member 150 and the second pressing member 151 are positioned at the separation position, the pivot shafts 150*a* and 151*a* are posited at the outermost sides of the pressing unit 140 in the longitudinal direction LD. In other words, the pressing portion 150*b* is positioned closer to the pivot shaft 151*a* than the pivot shaft 150*a* in the longitudinal direction LD, and the pressing portion 151*b* is positioned closer to the pivot shaft 150*a* than the pivot shaft 151*a* in the longitudinal direction LD. The distance between the pivot shafts 150*a* and 151*a* in the longitudinal direction LD is set to length L1.

As described, according to the present modified example, pivoting locus of the pressing portions 150*b* and 151*b* is positioned within length L1 which is the distance between the pressed portions 36 and 37, so that the apparatus including the pressing unit 140 can be downsized in the longitudinal direction LD.

Comparative Example

Figure 11A:
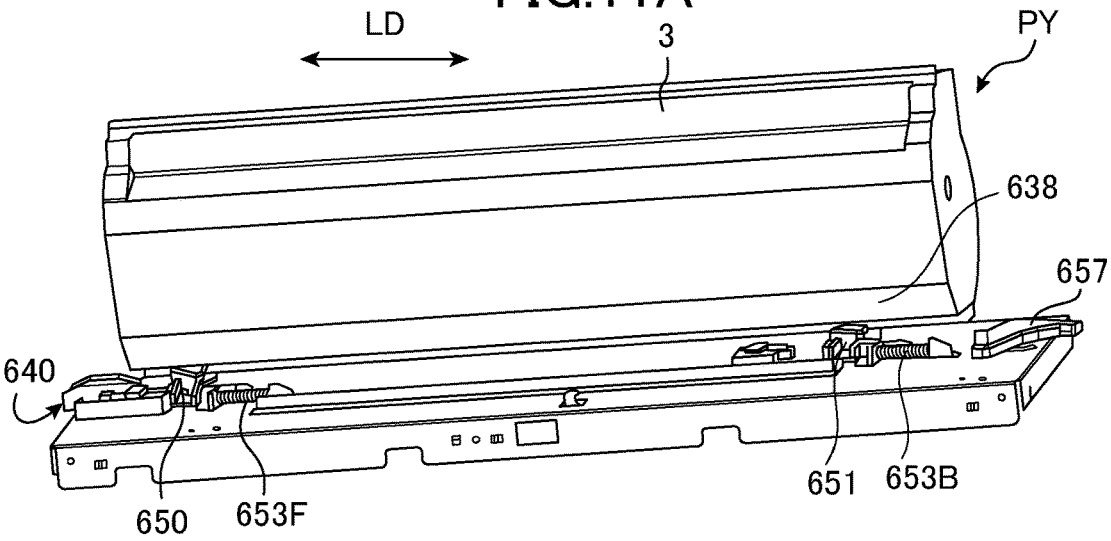
FIG. 11A is a perspective view illustrating a processing cartridge and a pressing unit according to a comparative example.
Figure 11B:
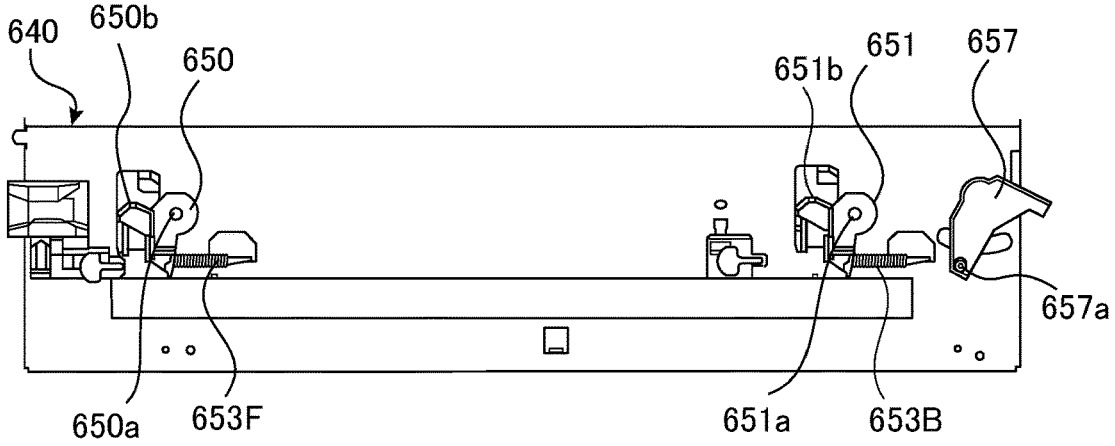
FIG. 11B is a plan view illustrating the pressing unit.
Figure 11C:
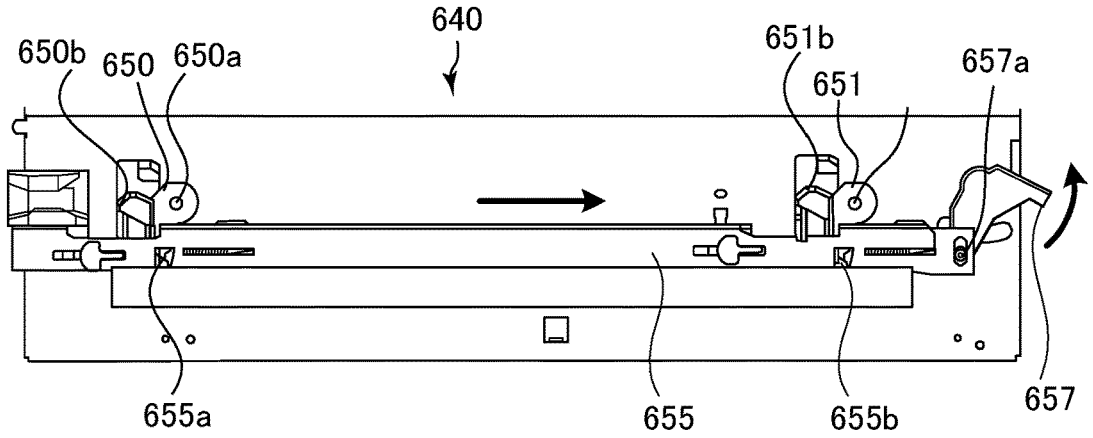
FIG. 11C is a plan view illustrating a separation operation of the pressing unit.

Another comparative example will be described with reference to FIGS. 11A to 12B. As illustrated in FIGS. 11A to 11C, a pressing unit 640 according to a comparative example is arranged on a lower portion of the processing cartridge PY. The pressing unit 640 includes a first pressing member 650, a second pressing member 651, a first spring 653F, a second spring 653B, a slide plate 655 and a separation cam 657.

The first pressing member 650 and the second pressing member 651 are arranged at mutually different positions in the longitudinal direction LD. The first pressing member 650 is supported pivotably around a pivot shaft 650*a* and urged by the first spring 653F. The second pressing member 651 is supported pivotably around a pivot shaft 651*a* and urged by the second spring 653B. Since the first pressing member 650 and the second pressing member 651 are respectively urged by the first spring 653F and the second spring 653B which are compression springs, the first pressing member 650 and the second pressing member 651 are pivoted in the same direction and presses a developing unit frame 638.

The separation cam 657 is connected to the slide plate 655 at a connection portion 657*a*, and the slide plate 655 is respectively engaged with the first pressing member 650 and the second pressing member 651 at engagement portions 655*a* and 655*b*. When a motor not shown rotates, the separation cam 657 pivots. Then, the slide plate 655 moves in sliding motion toward an arrow direction illustrated in FIG. 11C. The first pressing member 650 and the second pressing member 651 respectively pivot against the urging force of the first spring 653F and the second spring 653B and move from the contact position to the separation position.

Figure 12A:
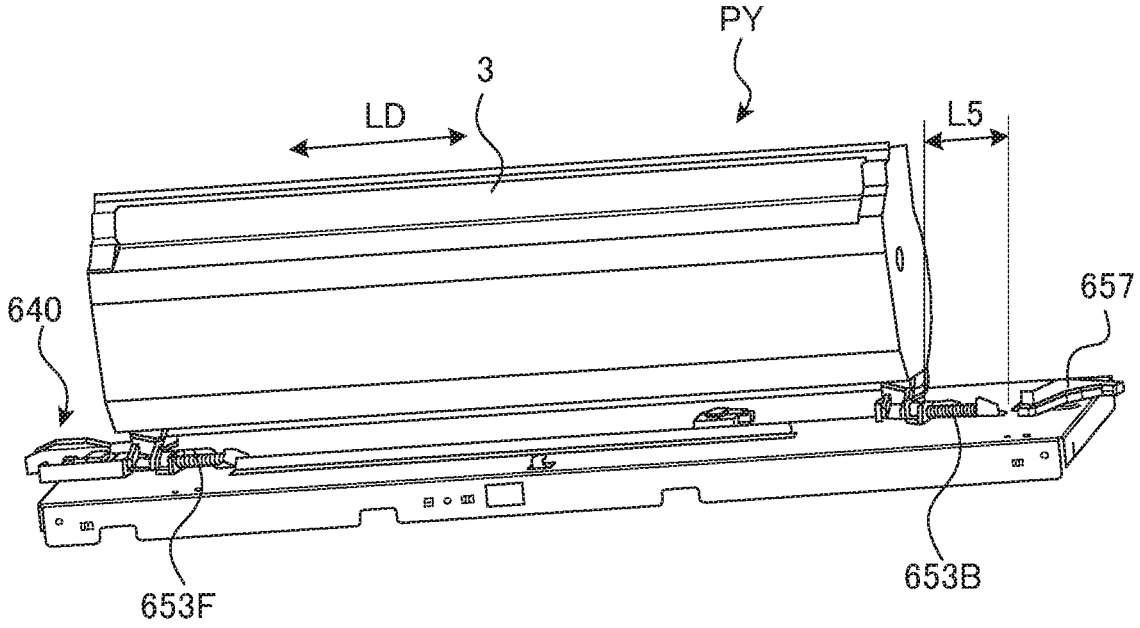
FIG. 12A is a perspective view illustrating a processing cartridge and a pressing unit according to a comparative example.
Figure 12B:
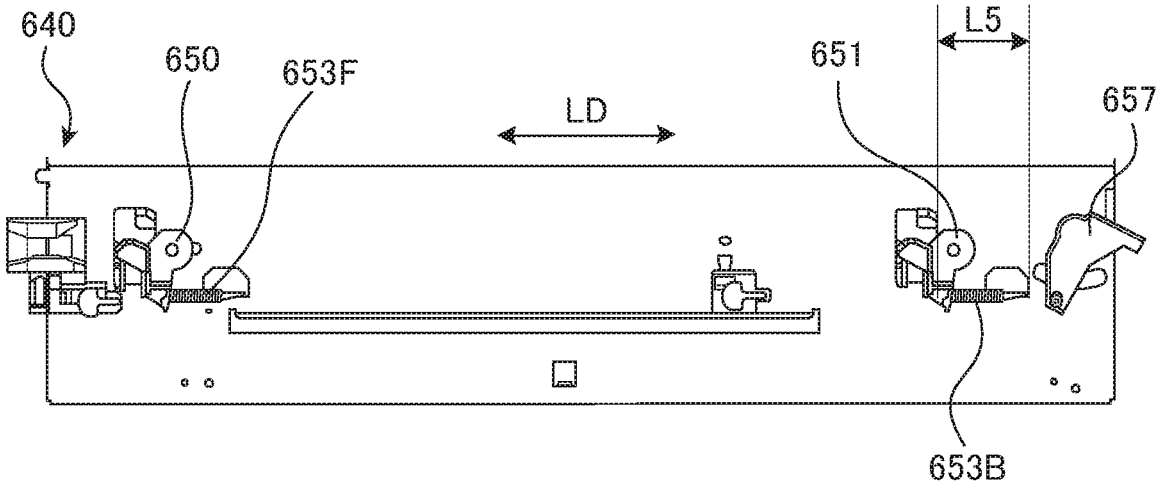
FIG. 12B is a plan view illustrating the pressing unit.

The first spring 653F is arranged in the area between the first pressing member 650 and the second pressing member 651 in the longitudinal direction LD. Meanwhile, as illustrated in FIGS. 12A and 12B, the second spring 653B is arranged to protrude outward than the second pressing member 651 in the longitudinal direction LD. Therefore, the size of the pressing unit 640 is increased for length L5 of the second spring 653B in the longitudinal direction LD. Further, since the pressing unit 640 is arranged below the processing cartridge PY, the size of the apparatus is increased in the height direction.

Spring Arrangement of Present Embodiment

According to the present embodiment, all of the first spring 53F and the second spring 53B is arranged in the area between the first pressing member 50 and the second pressing member 51 in the longitudinal direction LD, as illustrated in FIGS. 5A to 5D. Thereby, the pressing unit 40 can be downsized in the longitudinal direction LD.

As described, according to the present embodiment, the pressing unit 40 is arranged in the space SP surrounded by the intermediate transfer belt 15 and the processing cartridge PY, so that the pressing unit 40 can be arranged in a space-saving manner and the apparatus can be downsized in the height direction. This is caused by forming the developing unit frame 38 into a small size, since the pressing unit 40 is configured to press the pressed portions 36 and 37 arranged at positions corresponding to the bearing members 31 and 32 of the developing roller 5 in the longitudinal direction LD. That is, since the developing unit frame 38 is formed to have a small size, sufficient space SP for storing the pressing unit 40 can be ensured.

Further, when the first pressing member 50 and the second pressing member 51 of the pressing unit 40 are subjected to contact/separation operation, the first and second pressing members 50 and 51 are pivoted mutually in opposite directions, so that the apparatus can be downsized in the longitudinal direction LD. Further, since all of the first spring 53F and the second spring 53B are arranged in the area between the first pressing member 50 and the second pressing member 51 in the longitudinal direction LD, the apparatus can be downsized in the longitudinal direction LD.

Further, since the first slide plate 54 and the second slide plate 55 for performing separation operation of the first pressing member 50 and the second pressing member 51 is configured to move in mutually opposite directions by the center cam 56, the apparatus can be simplified and costs can be cut down. In further detail, the first pressing member 50 and the second pressing member 51 can be pivoted in mutually opposite directions by a single drive motor M, so that the apparatus can be simplified and costs can be cut down compared to a case where two drive motors M are provided.

Since the first spring 53F and the second spring 53B are composed of compression springs, an inexpensive pressing unit 40 adopting a simple configuration and configured to generate stable pressing force can be provided. Further, since the pressing forces P1 and P2 of the pressing portions 50*b* and 51*b* are directed along a short direction SD orthogonal to the longitudinal direction LD, the loss of pressing force from the first spring 53F and the second spring 53B can be minimized.

Second Embodiment

Next, a second embodiment of the present invention will be described. The configuration of a pressing unit according to the second embodiment differs from the first embodiment, and other configurations similar to the first embodiment are either not shown or denoted with the same reference numbers in the description.

Pressing Unit

The configurations of the first pressing member 50, the first slide plate 54 and the second slide plate 55 of the pressing unit 40 according to the first embodiment are changed in a pressing unit 240 according to the second embodiment, and other configurations are similar to the first embodiment.

Figure 8A:
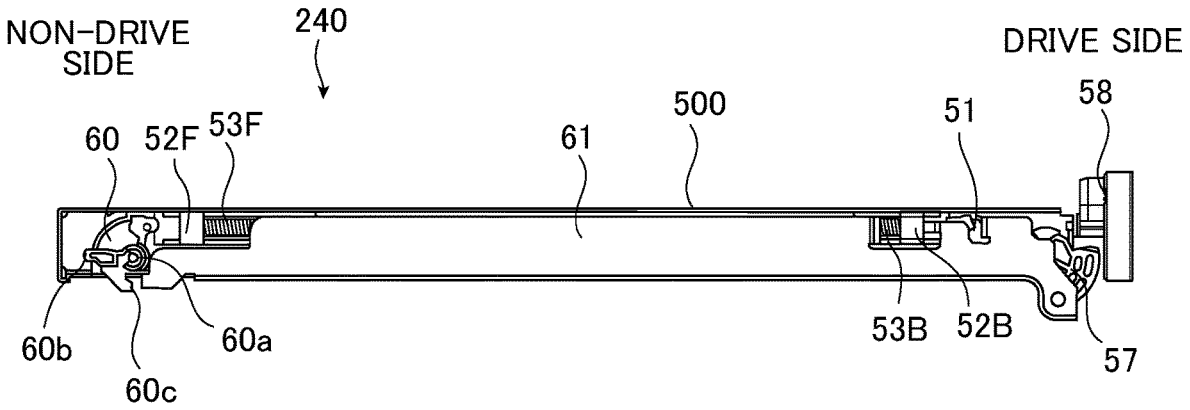
FIG. 8A is a plan view illustrating a pressing unit according to a second embodiment.

The pressing unit 240 includes, as illustrated in FIG. 8A, a first pressing member 60 supported pivotably around a pivot shaft 60*a* on the pressing stay 500, and a slide plate 61 serving as a moving member, i.e., moving unit. The slide plate 61 is connected to the separation cam 57 and engaged with the first pressing member 60 and the second pressing member 51. The first pressing member 60 pivots in the same direction as the second pressing member 51 during the contact/separation operation.

The first pressing member 60 includes a pressing portion 60*b* for pressing the pressed portion 36 (refer to FIG. 3A) of the developing unit frame 38, and an engaged portion 60*c* to be engaged with the slide plate 61. All of the first spring 53F and the second spring 53B are arranged in the area between the first and second pressing members 60 and 51 in the longitudinal direction LD.

Contact/Separation Operation

Figure 8B:
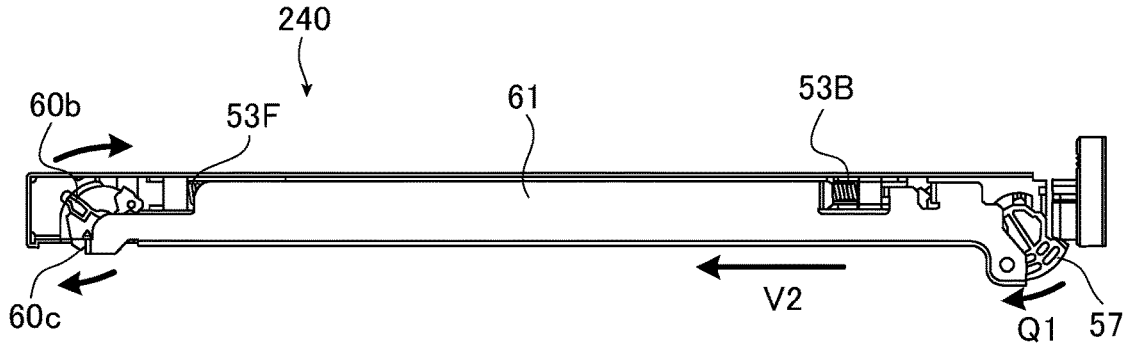
FIG. 8B is a plan view illustrating a slide plate of the pressing unit.

The contact operation of the first pressing member 60 and the contact/separation operation of the second pressing member 51 are similar to the first embodiment, so descriptions thereof are omitted. As illustrated in FIG. 8B, when the separation cam 57 is pressed by the cam gear 58 and pivoted in the direction of arrow Q1, the slide plate 61 is moved in sliding motion to the direction of arrow V2.

Then, the slide plate 61 presses the second pressing member 51 against the urging force of the second spring 53B, and the second pressing member 51 is positioned at the separation position. Further, the slide plate 61 presses the engaged portion 60*c* of the first pressing member 60 against the urging force of the first spring 53F, and the first pressing member 60 pivots in the direction of the arrow. Thereby, the first pressing member 60 is moved to the separation position.

Since all of the first spring 53F and the second spring 53B are arranged in the area between the first pressing member 60 and the second pressing member 51 in the longitudinal direction LD by adopting the above configuration, the apparatus can be downsized in the longitudinal direction LD. Further, since the first pressing member 60 and the second pressing member 51 are moved by the slide plate 61 moving in the longitudinal direction LD, the apparatus can be downsized in the direction orthogonal to the longitudinal direction LD.

Third Embodiment

Next, a third embodiment of the present invention will be described. The configuration of a pressing unit of the first embodiment is changed in the third embodiment, and other configurations similar to the first embodiment are either not shown or denoted with the same reference numbers in the description.

Pressing Unit

The configurations of the first pressing member 50, the second pressing member 51 and the slide members 52F and 52B of the pressing unit 40 according to the first embodiment are changed in a pressing unit 340 according to the third embodiment, and other configurations are similar to the first embodiment. Especially, in FIGS. 9A to 9E, the first slide plate 54 and the second slide plate 55 are omitted.

The pressing unit 340 includes a first pressing member 70, a second pressing member 71 and slide members 72F and 72B, as illustrated in FIGS. 9A to 9E. The first end portion 53F1 of the first spring 53F presses the first pressing member 70 via a slide member 72F. The third end portion 53B1 of the second spring 53B presses the second pressing member 71 via a slide member 72B. The slide member 72F is urged by the first spring 53F in the longitudinal direction LD and includes a boss 72*a*F. The first pressing member 70 includes a long hole 70*a* to which the boss 72*a*F is inserted, a pressing portion 70*b* for pressing the pressed portion 36 (refer to FIG. 3A) of the developing unit frame 38, and a guide groove 70*c* extending in the short direction SD.

A bent portion 73*a* provided on a pressing stay 73 is passed through the guide groove 70*c*, and the first pressing member 70 is configured to slidably move in the short direction SD by being engaged with the guide groove 70*c* and the bent portion 73*a*. The long hole 70*a* is extended in a direction crossing the longitudinal direction LD and the short direction SD.

The slide member 72B is urged by a first spring 53B in the longitudinal direction LD and includes a boss 72*a*B. The second pressing member 71 includes a long hole 71*a* to which the boss 72*a*B is inserted, a pressing portion 71*b* for pressing the pressed portion 37 (refer to FIG. 3A) of the developing unit frame 38, and a guide groove 71*c* extending in the short direction SD.

A bent portion 73*b* provided on the pressing stay 73 is passed through the guide groove 71*c*, and the second pressing member 71 is configured to slidably move in the short direction SD by engagement of the guide groove 71*c* and the bent portion 73*b*. The long hole 71*a* is extended in a direction crossing the longitudinal direction LD and the short direction SD.

Contact/Separation Operation

Now, a contact/separation operation in which the pressing portion 70*b* of the first pressing member 70 and the pressing portion 71*b* of the second pressing member 71 are respectively in contact with or separated from the pressed portions 36 and 37 (refer to FIG. 3A) of the developing unit frame 38 will be described.

Figure 9A:
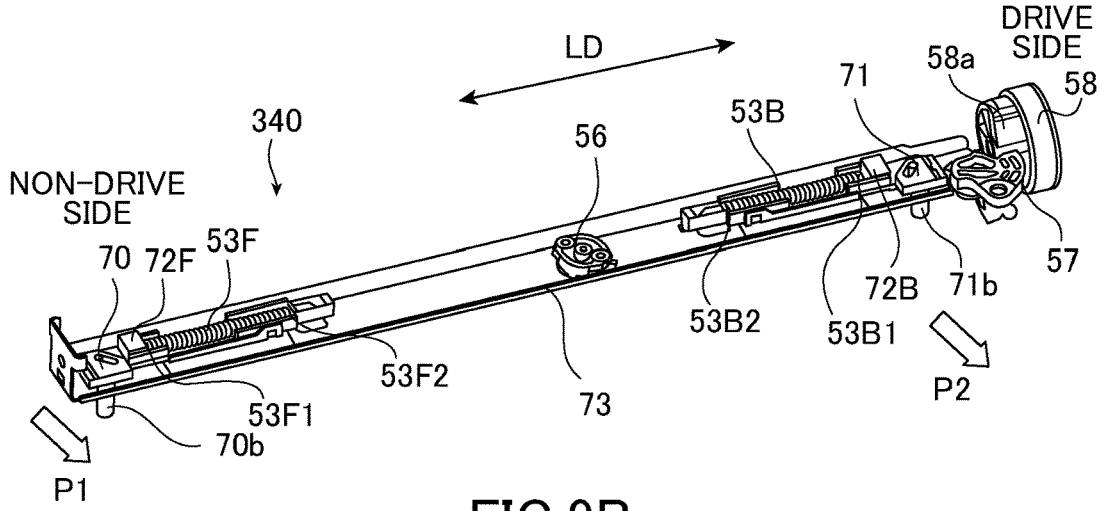
FIG. 9A is a perspective view illustrating a pressing unit according to a third embodiment.
Figure 9B:
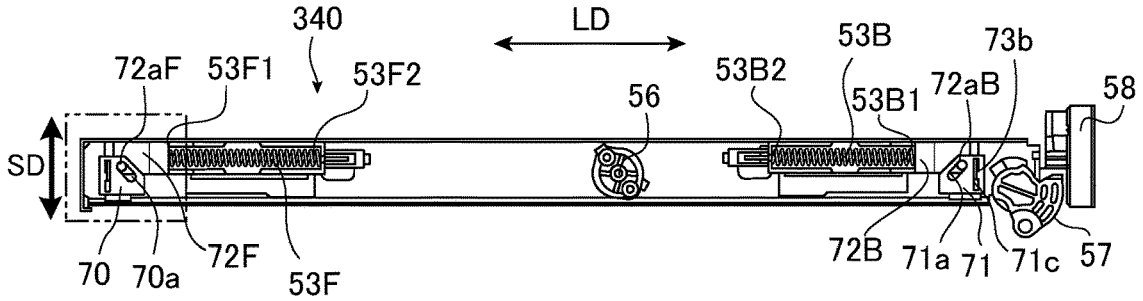
FIG. 9B is a plan view illustrating the pressing unit.

When the pressing portion 70*b* of the first pressing member 70 and the pressing portion 71*b* of the second pressing member 71 are in contact with the pressed portions 36 and 37, the drive motor M (refer to FIG. 5A) is in a stopped state and the cam gear 58 is positioned at the contact position, as illustrated in FIGS. 9A and 9B. In this state, the cam portion 58*a* of the cam gear 58 is separated from the separation cam 57.

In this state, the slide members 72F and 72B are urged by the first spring 53F and the second spring 53B toward the direction separating from the center cam 56 in the longitudinal direction LD. Then, the first pressing member 70 is pressed by the boss 72*a*F of the slide member 72F, as illustrated in FIG. 9D. By engagement of the boss 72*a*F and the long hole 70*a*, the urging force of the first spring 53F in the longitudinal direction LD is converted into the short direction SD, and the pressing portion 70*b* presses the pressed portion 36 (refer to FIG. 3A) of the developing unit frame 38 by pressing force P1.

The second pressing member 71 is pressed by the boss 72*a*B of the slide member 72B. By engagement of the boss 72*a*B and the long hole 71*a*, the urging force of the second spring 53B in the longitudinal direction LD is converted into the short direction SD, and the pressing portion 71*b* presses the pressed portion 37 (refer to FIG. 3A) of the developing unit frame 38 by pressing force P2.

Next, the separation operation of the first pressing member 70 and the second pressing member 71 will be described. The slide members 72F and 72B move in the direction to approach the center cam 56 against the urging force of the first spring 53F and the second spring 53B by the cam gear 58, the separation cam 57 and first and second slide plates not shown.

Figure 9C:
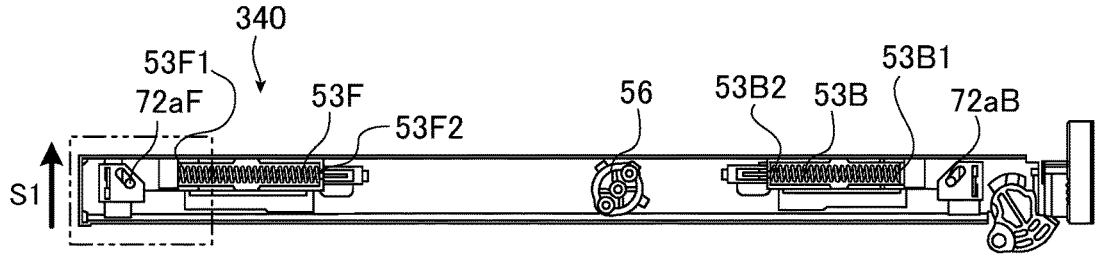
FIG. 9C is a plan view illustrating a first pressing member and a second pressing member positioned at a separation position.
Figure 9D:
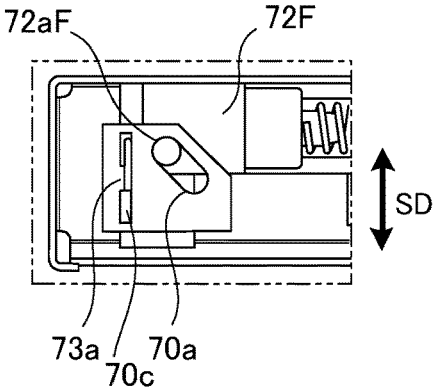
FIG. 9D is an enlarged plan view illustrating the first pressing member positioned at a contact position.
Figure 9E:
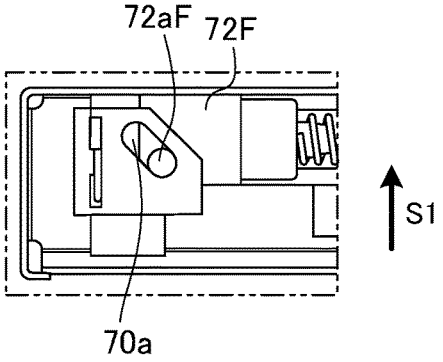
FIG. 9E is an enlarged plan view illustrating the first pressing member positioned at the separation position.

By engagement of the boss 72*a*F and the long hole 70*a*, the urging force of the first spring 53F in the longitudinal direction LD is converted into the short direction SD, and the first pressing member 70 is moved from the contact position to the separation position, as illustrated in FIGS. 9C and 9E. That is, the first pressing member 70 is moved in sliding motion in the direction of the arrow 51.

Further, by engagement of the boss 72*a*B and the long hole 71*a*, the urging force of the second spring 53B in the longitudinal direction LD is converted into the short direction SD, and the second pressing member 71 is moved from the contact position to the separation position, as illustrated in FIG. 9C. That is, the second pressing member 71 is moved in sliding motion in the direction of the arrow 51.

Even according to the configuration described above, all of the first spring 53F and the second spring 53B are arranged in the area between the first pressing member 70 and the second pressing member 71 in the longitudinal direction LD. In other words, the second end portion 53F2 is arranged between the first pressing member 70 and the second pressing member 71, that is, on the inner side of the first pressing member 70 and the second pressing member 71, in the longitudinal direction LD. The fourth end portion 53B2 is arranged between the first pressing member 70 and the second pressing member 71, that is, on the inner side of the first pressing member 70 and the second pressing member 71, in the longitudinal direction LD. Thereby, the apparatus can be downsized in the longitudinal direction LD. Further, by moving the first pressing member 70 and the second pressing member 71 by the first slide plate 54 and the second slide plate 55 moving in the longitudinal direction LD, the apparatus can be downsized in the direction orthogonal to the longitudinal direction LD.

In the present embodiment, the first pressing member 70 and the second pressing member 71 are provided movably in the short direction SD, but the present invention is not limited thereto. That is, the first pressing member 70 and the second pressing member 71 can be respectively provided slidably in the first crossing direction and the second crossing direction which are directions crossing the longitudinal direction LD.

Fourth Embodiment

Next, a fourth embodiment of the present invention will be described. The configuration of a pressing unit according to the fourth embodiment differs from the first embodiment, and other configurations similar to the first embodiment are either not shown or denoted with the same reference numbers in the description.

Pressing Unit

The configurations of the first pressing member 50, the first spring 53F, the second spring 53B, the first slide plate 54 and the second slide plate 55 according to the first embodiment are changed in a pressing unit 440 according to the fourth embodiment. Other configurations are similar to the first embodiment.

Figure 10A:
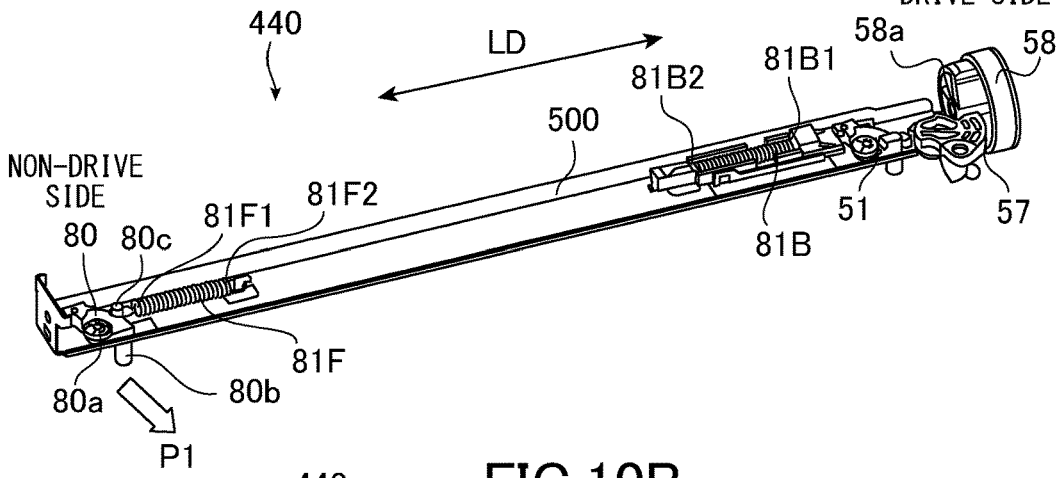
FIG. 10A is a perspective view illustrating a pressing unit according to a fourth embodiment.

The pressing unit 440 includes a first pressing member 80 pivotably supported on the pressing stay 500 around a pivot shaft 80*a*, a first spring 81F, a second spring 81B and a slide plate 82, as illustrated in FIG. 10A. The first pressing member 80 pivots in a same direction as the second pressing member 51 during contact/separation operation. The slide plate 82 is a moving member, i.e., moving unit, according to the present embodiment.

The first pressing member 80 includes a pressing portion 80*b* that presses the pressed portion 36 (refer to FIG. 3A) of the developing unit frame 38, and a connection portion 80*c* connected to the first spring 81F. The first spring 81F is a tension spring and a second spring 82B is a compression spring. The first pressing member 80 is urged by the first spring 81F toward a direction opposite to the direction of the arrow illustrated in FIG. 10B. Similarly, the second pressing member 51 is urged by the second spring 81B toward a direction opposite to the direction of the arrow illustrated in FIG. 10B.

The first spring 81F includes a first end portion 81F1 and a second end portion 81F2 on an opposite side of the first end portion 81F1. More specifically, the second end portion 81F2 is arranged on an opposite side of the first end portion 81F1 in the direction of deformation of the first spring 81F, and it is positioned on the inner side of the first end portion 81F1 in the longitudinal direction LD. The second end portion 81F2 is arranged at a position more distant from the first pressing member 80 than the first end portion 81F1. The first end portion 81F1 is attached to the first pressing member 80. The second end portion 81F2 is supported on the pressing stay 500.

The second spring 81B includes a third end portion 81B1 and a fourth end portion 81B2 on an opposite side of the third end portion 81B1. More specifically, the fourth end portion 81B2 is arranged on an opposite side of the third end portion 81B1 in the direction of deformation of the second spring 81B, and it is positioned on the inner side of the third end portion 81B1 in the longitudinal direction LD. The fourth end portion 81B2 is arranged at a position more distant from the second pressing member 51 than the third end portion 81B1. The fourth end portion 81B2 is supported on the pressing stay 500.

Figure 10B:
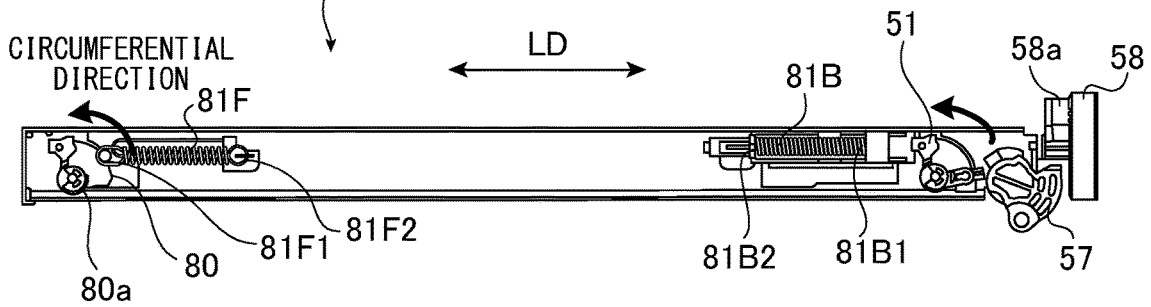
FIG. 10B is a plan view illustrating the pressing unit.
Figure 10C:
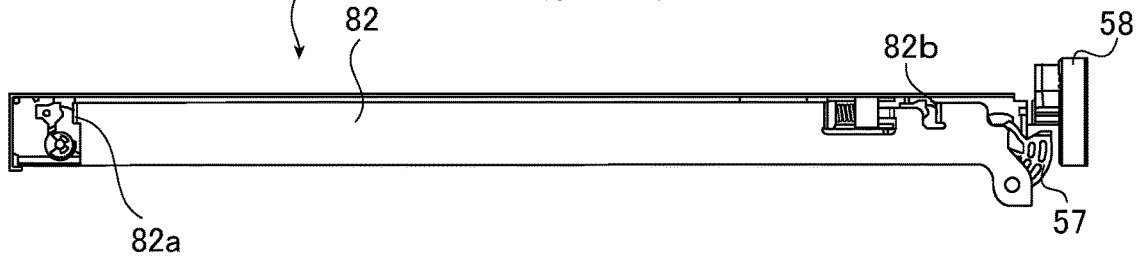
FIG. 10C is a plan view illustrating a slide plate of the pressing unit.

The slide plate 82 is connected to the separation cam 57 and includes engagement portions 82*a* and 82*b* that are respectively engaged with the first pressing members 80 and the second pressing member 51, as illustrated in FIG. 10C. All of the first spring 81F and the second spring 81B are arranged in the area between the first pressing member 80 and the second pressing member 51. In other words, the second end portion 81F2 is arranged between the first pressing member 80 and the second pressing member 51, that is, on the inner side of the first pressing member 80 and the second pressing member 51, in the longitudinal direction LD. The fourth end portion 81B2 is arranged between the first pressing member 80 and the second pressing member 51, that is, on the inner side of the first pressing member 80 and the second pressing member 51, in the longitudinal direction LD.

Contact/Separation Operation

Now, a contact/separation operation in which the pressing portion 80*b* of the first pressing member 80 and the pressing portion 51*b* of the second pressing member 51 are respectively in contact with or separated from the pressed portions 36 and 37 (refer to FIG. 3A) of the developing unit frame 38 will be described. The contact/separation operation of the second pressing member 51 is similar to the first embodiment so descriptions thereof are omitted.

When the pressing portion 80*b* of the first pressing member 80 and the pressing portion 51*b* of the second pressing member 51 are in contact with the pressed portions 36 and 37, the drive motor M (refer to FIG. 5A) is in a stopped state and the cam gear 58 is positioned at the contact position, as illustrated in FIGS. 10A and 10B. In this state, the cam portion 58*a* of the cam gear 58 is separated from the separation cam 57.

In this state, the first pressing member 80 is urged by the first spring 81F composed of a tension spring toward a direction opposite to the direction of the arrow illustrated in FIG. 10B. Thereby, the pressing portion 80*b* of the first pressing member 80 presses the pressed portion 36 (refer to FIG. 3A) of the developing unit frame 38 by pressing force P1.

Figure 10D:
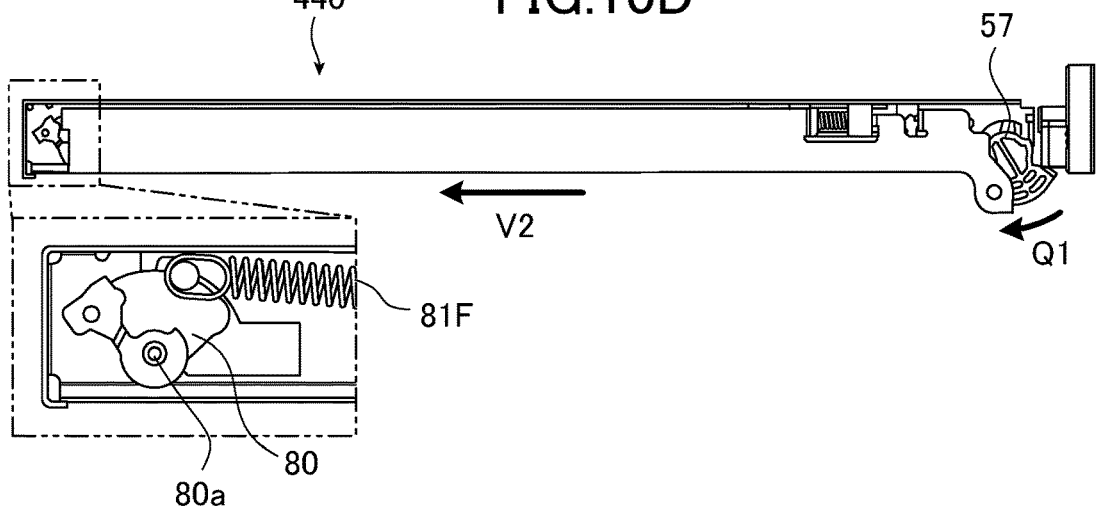
FIG. 10D is an enlarged plan view illustrating a first pressing member positioned at a contact position.

Next, the separation operation of the first pressing member 80 will be described. When the slide plate 82 is moved in sliding motion to the direction of arrow V2 illustrated in FIG. 10D by the separation cam 57 pivoting in the direction of arrow Q1, the engagement portion 82*a* of the slide plate 82 presses the first pressing member 80 against the urging force of the first spring 81F. Thereby, the first pressing member 80 pivots in the direction of the arrow illustrated in FIG. 10B. That is, the first pressing member 80 moves from the contact position to the separation position.

Since all of the first spring 81F and the second spring 81B are arranged in the area between the first pressing member 80 and the second pressing member 51 in the longitudinal direction LD by adopting the above configuration, the apparatus can be downsized in the longitudinal direction LD. Further, since the first spring 81F is a tension spring and the second spring 82B is a compression spring, the slide plate 82 can move the first pressing member 80 and the second pressing member 51 without using the center cam 56. Since the first pressing member 80 and the second pressing member 51 are moved by the slide plate 82 moving in the longitudinal direction LD, the apparatus can be downsized in the direction orthogonal to the longitudinal direction LD.

If the first spring 81F and the second spring 81B are composed of tension springs, the first and second springs 81F and 81B will not be easily buckled even if the spring has a small inner diameter, so that the ease of assembly can be improved.

Other Embodiments

The pressing unit can be configured to press areas other than the upper portion of the developing unit frame 38, such as the lower portion thereof. Further, various embodiments described above can be combined arbitrarily.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-167918, filed Sep. 17, 2019, Japanese Patent Application No. 2020-024679, filed Feb. 17, 2020, and Japanese Patent Application No. 2020-117616, filed Jul. 8, 2020 which are hereby incorporated by reference herein in their entirety.

What is claimed is:

1. An image forming apparatus comprising:

a photosensitive member configured to be rotatable and bear an electrostatic latent image;

a developing unit comprising a developing member configured to develop the electrostatic latent image by supplying developer to the photosensitive member;

a first pressing member comprising a first pressing portion configured to press the developing unit such that the developing member approaches the photosensitive member, the first pressing member configured to move between a first pressing position in which the first pressing portion presses the developing unit and a first separation position in which the first pressing portion is separated from the developing unit;

a second pressing member comprising a second pressing portion configured to press the developing unit such that the developing member approaches the photosensitive member, the second pressing member configured to move between a second pressing position in which the second pressing portion presses the developing unit and a second separation position in which the second pressing portion is separated from the developing unit, the second pressing member being arranged at a position different from the first pressing member in an axial direction of the photosensitive member;

a moving unit configured to move in the axial direction so as to move the first pressing member and the second pressing member;

a first urging member comprising a first end portion and a second end portion positioned on an opposite side of the first end portion, the first urging member configured to urge the first pressing member to the first pressing position; and a second urging member comprising a third end portion and a fourth end portion positioned on an opposite side of the third end portion, the second urging member configured to urge the second pressing member to the second pressing position, wherein the second end portion is arranged more distant from the first pressing member than the first end portion and is arranged between the first pressing member and the second pressing member in the axial direction, and the fourth end portion is arranged more distant from the second pressing member than the third end portion and is arranged between the first pressing member and the second pressing member in the axial direction.

2. The image forming apparatus according to claim 1, wherein the first urging member and the second urging member are each a compression spring.

3. The image forming apparatus according to claim 1, wherein the first urging member and the second urging member are each a tension spring.

4. The image forming apparatus according to claim 1, wherein the first urging member is a tension spring, and the second urging member is a compression spring.

5. The image forming apparatus according to claim 1, wherein the first pressing member is configured to slidably move in a first crossing direction crossing the axial direction between the first pressing position and the first separation position, and the second pressing member is configured to slidably move in a second crossing direction crossing the axial direction between the second pressing position and the second separation position.

6. The image forming apparatus according to claim 5, wherein the first crossing direction and the second crossing direction are each a direction orthogonal to the axial direction.

7. The image forming apparatus according to claim 1, wherein the first pressing member is configured to pivot around a first axis, and the second pressing member is configured to pivot around a second axis parallel to the first axis.

8. The image forming apparatus according to claim 1, further comprising a first bearing member and a second bearing member that are configured to support the developing member such that the developing member is rotatable, wherein the first pressing portion overlaps with the first bearing member in the axial direction in a state where the first pressing member is positioned at the first pressing position, and the second pressing portion overlaps with the second bearing member in the axial direction in a state where the second pressing member is positioned at the second pressing position.

9. The image forming apparatus according to claim 1, wherein the moving unit comprises a first moving member configured to engage with the first pressing member, and a second moving member configured to engage with the second pressing member, and the image forming apparatus further comprises:

an interlocking unit connected to the first moving member and the second moving member, the interlocking unit interlocking the first moving member and the second moving member to move in mutually opposite directions in the axial direction; and a driving member configured to drive the second moving member in the axial direction.

10. The image forming apparatus according to claim 1, further comprising a driving member configured to drive the moving unit in the axial direction, wherein the moving unit is configured to engage with the first pressing member and the second pressing member.

11. The image forming apparatus according to claim 1, wherein the developing unit comprises a first pressed portion pressed by the first pressing portion, and a second pressed portion pressed by the second pressed portion, and the first pressed portion and the second pressed portion are arranged on an upper portion of the developing unit.

12. The image forming apparatus according to claim 1, further comprising:

an intermediate transfer body configured to bear a toner image; and a transfer portion configured to transfer the toner image formed on the photosensitive member to the intermediate transfer body, wherein the first pressing member and the second pressing member are arranged in a space surrounded by the intermediate transfer body, the photosensitive member and the developing unit.

13. The image forming apparatus according to claim 1, wherein the first pressing portion and the second pressing portion are configured to press the developing unit in a direction orthogonal to the axial direction.

14. An image forming apparatus comprising:

a photosensitive member configured to be rotatable and bear an electrostatic latent image;

a developing unit comprising a developing member configured to develop the electrostatic latent image by supplying developer to the photosensitive member;

a first pressing member comprising a first pressing portion configured to press the developing unit such that the developing member approaches the photosensitive member, the first pressing member configured to pivot around a first axis between a first pressing position in which the first pressing portion presses the developing unit and a first separation position in which the first pressing portion is separated from the developing unit;

a second pressing member comprising a second pressing portion configured to press the developing unit such that the developing member approaches the photosensitive member, the second pressing member configured to pivot around a second axis parallel to the first axis between a second pressing position in which the second pressing portion presses the developing unit and a second separation position in which the second pressing portion is separated from the developing unit, the second pressing member being arranged at a position different from the first pressing member in an axial direction of the photosensitive member; and a moving unit configured to move in the axial direction so as to move the first pressing member and the second pressing member, wherein the first pressing member is configured to pivot in a first direction around the first axis when pivoting from the first pressing position to the first separation position, the second pressing member is configured to pivot in a second direction opposite to the first direction around the second axis when pivoting from the second pressing position to the second separation position, the first pressing portion is configured to move so as to approach the second axis in the axial direction in a case where the first pressing member pivots in the first direction around the first axis, and the second pressing portion is configured to move so as to approach the first axis in the axial direction in a case where the second pressing member pivots in the second direction around the second axis.

15. The image forming apparatus according to claim 14, wherein the first pressing portion is positioned farther from the second axis than the first axis in the axial direction in a state where the first pressing member is positioned at the first pressing position, and the second pressing portion is positioned farther from the first axis than the second axis in the axial direction in a state where the second pressing member is positioned at the second pressing position.

16. The image forming apparatus according to claim 14, wherein the first pressing portion is positioned closer to the second axis than the first axis in the axial direction in a state where the first pressing member is positioned at the first separation position, and the second pressing portion is positioned closer to the first axis than the second axis in the axial direction in a state where the second pressing member is positioned at the second separation position.

17. The image forming apparatus according to claim 14, further comprising a first bearing member and a second bearing member that are configured to support the developing member such that the developing member is rotatable, wherein the first pressing portion overlaps with the first bearing member in the axial direction in a state where the first pressing member is positioned at the first pressing position, and the second pressing portion overlaps with the second bearing member in the axial direction in a state where the second pressing member is positioned at the second pressing position.

18. The image forming apparatus according to claim 14, wherein the moving unit comprises a first moving member configured to engage with the first pressing member and move in the axial direction, and a second moving member configured to engage with the second pressing member and move in the axial direction, the image forming apparatus further comprises:

an interlocking unit connected to the first moving member and the second moving member, the interlocking unit interlocking the first moving member and the second moving member to move in mutually opposite directions in the axial direction; and a driving member configured to drive the second moving member in the axial direction.

19. The image forming apparatus according to claim 14, wherein the developing unit comprises a first pressed portion pressed by the first pressing portion, and a second pressed portion pressed by the second pressing portion, and the first pressed portion and the second pressed portion are arranged at an upper portion of the developing unit.

20. An image forming apparatus comprising:

a photosensitive member configured to be rotatable and bear an electrostatic latent image;

a developing unit comprising a developing member configured to develop the electrostatic latent image by supplying developer to the photosensitive member;

a first pressing member comprising a first pressing portion configured to press the developing unit such that the developing member approaches the photosensitive member, the first pressing member configured to move between a first pressing position in which the first pressing portion presses the developing unit and a first separation position in which the first pressing portion is separated from the developing unit;

a second pressing member comprising a second pressing portion configured to press the developing unit such that the developing member approaches the photosensitive member, the second pressing member configured to move between a second pressing position in which the second pressing portion presses the developing unit and a second separation position in which the second pressing portion is separated from the developing unit, the second pressing member being arranged at a position different from the first pressing member in an axial direction of the photosensitive member;

a first urging member comprising a first end portion and a second end portion positioned on an opposite side of the first end portion, the first urging member configured to urge the first pressing member to the first pressing position; and a second urging member comprising a third end portion and a fourth end portion positioned on an opposite side of the third end portion, the second urging member configured to urge the second pressing member to the second pressing position, wherein the first urging member is a tension spring, and the second urging member is a compression spring.

* * * * *